US005512425A

United States Patent [19]

Kase

[11] Patent Number: 5,512,425

[45] Date of Patent: Apr. 30, 1996

[54] SILVER HALIDE COLOR PHOTOGRAPHIC LIGHT-SENSITIVE MATERIAL AND METHOD FOR FORMING COLOR IMAGE THEREWITH

[75] Inventor: Akira Kase, Kanagawa, Japan

[73] Assignee: Fuji Photo Film Co., Ltd., Kanagawa, Japan

[21] Appl. No.: 517,669

[22] Filed: Aug. 22, 1995

Related U.S. Application Data

[63] Continuation of Ser. No. 159,316, Nov. 30, 1993, abandoned.

[30] Foreign Application Priority Data

Nov. 30, 1992 [JP] Japan ..... 4-341015

[51] Int. Cl.[6] ..... G03C 1/76

[52] U.S. Cl. ..... 430/533; 430/558; 430/642

[58] Field of Search ..... 430/642, 533, 430/558

[56] References Cited

U.S. PATENT DOCUMENTS

| | | | |
|---|---|---|---|
| 4,917,994 | 4/1990 | Martinez et al. | 430/543 |
| 4,980,274 | 12/1990 | Tai et al. | 430/533 |
| 5,075,208 | 12/1991 | Watanabe et al. | 430/559 |
| 5,256,526 | 10/1993 | Suzuki et al. | 430/558 |
| 5,273,867 | 12/1993 | Shibuya et al. | 430/551 |

FOREIGN PATENT DOCUMENTS 507489 10/1992 European Pat. Off. .

OTHER PUBLICATIONS

Carroll, B. H.; Higgins, G. C.; James, T. H. *Introduction to Photographic Theory: The Silver Halide Process,* John Wiley & Sons, Inc., 1980, p. 132.

*Primary Examiner*—Janet C. Baxter

*Attorney, Agent, or Firm*—Sughrue, Mion, Zinn, Macpeak & Seas

[57] ABSTRACT

A color photographic light-sensitive material has excellent smoothness and glossiness on the surface of the light-sensitive material and provides good color developing performance and excellent color reproduction performance as well as less pressure fog in aging and storage. The light-sensitive material comprises a reflective support having provided thereon at least one yellow dye forming coupler-containing silver halide emulsion layer, at least one magenta dye forming coupler-containing silver halide emulsion layer, and at least one cyan dye forming coupler-containing silver halide emulsion layer, each having a different light sensitivity, wherein the reflective support comprises a substrate having provided at least on the surface of an emulsion layer-coated side thereof, a composition prepared by mixing and dispersing a white pigment in a resin containing polyester as a main component; the cyan dye forming coupler-containing silver halide emulsion layer contains at least one cyan dye forming coupler compound represented by the following formula (Ia); and the film pH of the light-sensitive material is 4.0 to 6.5:

(Ia)

wherein $R_1$ and $R_2$ each represents an electron attractive group having a Hammett's substituent constant $\sigma_p$ of 0.20 or more, provided that the sum of the $\sigma_p$ values of $R_1$ and $R_2$ is 0.65 or more, and Za, Zb, Zc, and X are as defined in the specification.

20 Claims, No Drawings

SILVER HALIDE COLOR PHOTOGRAPHIC LIGHT-SENSITIVE MATERIAL AND METHOD FOR FORMING COLOR IMAGE THEREWITH

This is a Continuation of application No. 08/159,316 filed Nov. 30, 1993 now abandoned.

FIELD OF THE INVENTION

The present invention relates to a silver halide color photographic light-sensitive material and a method for forming a color image therewith. More specifically, the invention relates to a color photographic light-sensitive material having an excellent smoothness and glossiness on the surface of the light-sensitive material and providing a good color developing performance and an excellent color reproduction performance as well as less pressure fog in aging and storing the light-sensitive material, and to a method for forming a color image therewith.

BACKGROUND OF THE INVENTION

The color image-forming method most generally used in a silver halide color photographic light-sensitive material includes a method in which an aromatic primary amine series color developing agent oxidized with exposed silver halide as an oxidizing agent is reacted with a coupler to form indophenol, indo-aniline, indamine, azomethine, phenoxazine, phenazine, and the dyes equivalent thereto. In such a system, a method in which a color image is reproduced by a subtractive color process is used, and generally the amounts of the three color dyes formed of yellow, magenta and cyan are changed to form the color image.

A phenol series or naphthol series cyan coupler is generally used for forming a cyan dye image. However, these couplers have a problem in that since they have an unfavorable absorption in the green light region and the blue light region, they markedly deteriorate particularly the color reproduction performance of blue and green colors, and therefore it is strongly desired to solve this problem.

The 2,4-diphenylimidazole series cyan couplers described in European Patent 0,249,453A2 have been proposed as a means for solving this problem. In the dyes formed from these couplers, the absorptions in the green and blue regions are reduced as compared with a conventional dye and they are certainly preferable in terms of color reproduction. However, the color reproduction performance can not be regarded sufficient even with these couplers and further improvement is desired. Further, there are other serious problems with these couplers. Their reactivity with the oxidation product of a developing agent, that is, their coupling activity, is low. Also, the dyes formed have a notably low fastness to heat and light. Therefore these couplers are not suited for practical use.

Further, in the pyrazoloazole series cyan couplers described in JP-A-64-552 (the term "JP-A" as used herein means an unexamined published Japanese patent application), JP-A-64-553, JP-A-64-554, JP-A-64-555, JP-A-64-556, and JP-A- 64-557, the unfavorable absorptions in the green and blue regions are reduced as compared with the conventional dyes but the color reproduction performance is not sufficient as well and the problem that their color developing performance is markedly low still remains.

Further, the pyrrolopyrazole series cyan couplers are disclosed in European Patent 0,456,226A1 as a coupler providing an excellent hue. These couplers are improved in terms of their color reproduction performance as compared with the above couplers but they are not yet sufficient and have the defect that the color fog is large in the unexposed areas. In addition, their color developing performance has not yet reached a sufficiently satisfactory level.

The pyrrolotriazole series cyan couplers having a specific substituent described in European Patents 0,491,197 and 0,488,248 have been found out as the cyan coupler which reconciles the above subjects in the cyan coupler, that is, a good color developing performance and less unfavorable absorptions in the green and blue regions. These cyan couplers form a dye having an excellent absorption characteristic, that is, a dye having a large molar absorption coefficient and a sharp spectral band width in a short wavelength (the unfavorable absorptions in the green and blue regions are reduced) and have a high reactivity with a developing agent oxidation product. In addition, the dyes formed therefrom have an excellent fastness to light and heat and therefore they are preferred.

Meanwhile, in a conventional color photographic paper, a polyolefin layer containing titanium oxide kneaded and dispersed therein is provided on the surface of the emulsion-coated side of a substrate in order to increase the light reflection efficiency as well as the waterproof performance. In this case, while titanium oxide raises the image quality by increasing particularly the whiteness degree of the photographic paper, it tends to deteriorate the flatness and the glossiness of the photographic paper surface.

European Patent 0,507,489 discloses a support on which a composition comprising a resin containing polyester as a main component and a white pigment is coated at least on the surface of the emulsion-coated side. The whiteness degree can be raised by this technique without deteriorating the smoothness and the glossiness on the surface of a photographic paper.

SUMMARY OF THE INVENTION

The present inventors prepared a silver halide color light-sensitive material comprising a reflective support provided at least on the surface of an emulsion layer-coated side of a substrate with a composition in which a white pigment is kneaded and dispersed in a resin containing polyester as a main component, and provided thereon a silver halide emulsion layer containing the above pyrrolotriazole cyan coupler to further continue research for the purpose of preparing a color photographic paper having an excellent smoothness and glossiness on the surface of the light-sensitive material and providing a good color developing performance and an excellent color reproduction performance. The results thereof showed that there was involved the problem that the pressure fog generated after aging and storing the light-sensitive material was large. This problem was relatively small when a conventional phenol series or naphthol series coupler was used as a cyan coupler but it was notably revealed when the above mentioned pyrrolotriazole coupler represented by formula (Ia) below was used.

It was found that the above mentioned pressure fog was observed to some extent in a light-sensitive material immediately after preparing the material but it was notable particularly in the light-sensitive material which was stored for aging.

Accordingly, an object of the present invention is to provide a color photographic light-sensitive material having an excellent smoothness and glossiness on the surface of the light-sensitive material and providing a good color developing performance and an excellent color reproduction performance as well as less pressure fog in aging and storing the light-sensitive material, and to provide a method for forming a color image therewith.

This object of the present invention has been effectively achieved by the following color photographic light-sensitive material and the method for forming a color image in which it is used:

(1) A silver halide color photographic light-sensitive material comprising a reflective support having provided thereon at least one yellow dye forming coupler-containing silver halide emulsion layer, at leat one magenta dye forming coupler-containing silver halide emulsion layer, and at least one cyan dye forming coupler-containing silver halide emulsion layer each having a different light sensitivity, wherein the reflective support comprises a substrate having provided at least on the surface of an emulsion layer-coated side thereof, a composition prepared by mixing and dispersing a white pigment in a resin containing polyester as a main component; the cyan dye forming coupler-containing silver halide emulsion layer contains at least one cyan dye forming coupler compound represented by the following formula (Ia); and the film pH of the light-sensitive material is 4.0 to 6.5:

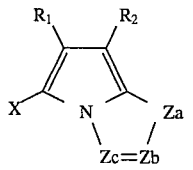

(Ia)

wherein Za represents —NH— or —CH($R_3$)—, and Zb and Zc each represents —C($R_4$)= or —N=; $R_1$, $R_2$ and $R_3$ each represents an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$'s are present in the formula, they may be the same or different; X represents a hydrogen atom or a group capable of splitting off upon a reaction with an oxidation product of an aromatic primary amine color developing agent; and a group represented by $R_1$, $R_2$, $R_3$, $R_4$ or X may become a divalent group and combine with a polymer higher than a dimer and a high molecular chain to form a homopolymer or a copolymer.

(2) The silver halide color photographic light-sensitive material described in the above item (1), wherein the polyester coated on the reflective support is a polyester containing polyethylene terephthalate as a main component.

(3) The silver halide color photographic light-sensitive material described in the above item (1), wherein the polyester coated on the reflective support is a polyester obtained by the polycondensation of a dicarboxylic acid and a diol; and the dicarboxylic acid component is a mixture of terephthalic acid and isophthalic acid.

(4) The silver halide color photographic light-sensitive material described in the above item (1), wherein the polyester coated on the reflective support is a polyester obtained by the polycondensation of a dicarboxylic acid and a diol; and the dicarboxylic acid component is a mixture of terephthalic acid and naphthalenedicarboxylic acid.

(5) The silver halide color photographic light-sensitive material described in the above item (2), (3) or (4), wherein the diol component is ethylene glycol.

(6) The silver halide color photographic light-sensitive material described in the above (1), (2), (3), (4) or (5), wherein the white pigment is titanium oxide; and the weight ratio of titanium oxide to the resin containing polyester as the main component is 5/95 to 50/50.

(7) A method for forming a color image, comprising subjecting the silver halide color photographic light-sensitive material described in the above items (1), (2), (3), (4), (5) or (6) to an exposure by a scanning exposure system in which the exposing time per picture element is less than $10^{-4}$ second, and then to a color development processing.

DETAILED DESCRIPTION OF THE INVENTION

The support according to the present invention will be explained below in detail.

In the present specification, the expression "main component" means a content of 50 weight % or more.

The reflective support according to the present invention is required to be a reflective support which is coated at least on the surface of an emulsion-coated side with a composition prepared by mixing and dispersing a white pigment in a resin containing polyester as a main component.

This polyester is a polyester synthesized by the polycondensation of a dicarboxylic acid with a diol. There can be enumerated as the preferred dicarboxylic acid, terephthalic acid, isophthalic acid, and naphthalenedicarboxylic acid. There can be enumerated as the preferred diol, ethylene glycol, butylene glycol, neopentyl glycol, triethylene glycol, butanediol, hexylene glycol, a bisphenol A/ethylene oxide adduct (2,2-bis(4-(2-hydroxyethyloxy)phenyl)propane), and 1,4-dihydroxymethylcyclohexane.

In the present invention, there can be used various polyesters obtained by subjecting one or more of these dicarboxylic acids to a polycondensation with one or more of the diols. Above all, at least one of the dicarboxylic acids is preferably terephthalic acid. Further, preferably used as well is a dicarboxylic acid component which is a mixture of terephthalic acid and isophthalic acid (mole ratio 9:1 to 2:8) or a mixture of terephthalic acid and naphthalenedicarboxylic acid (mole ratio 9:1 to 2:8). Ethylene glycol or a mixed diol containing ethylene glycol is preferably used as the diol. The molecular weight of these polymers is preferably 30,000 to 50,000.

A mixture of plural kinds of polyesters each having a different composition is preferably used as well. Further, a mixture of these polyesters and other resins is preferably used. There can be widely selected as the other mixed resins, polyolefins such as polyethylene and polypropylene, polyether such as polyethylene glycol, polyoxymethylene, and polyoxypropylene, polyester series polyurethane, polyether polyurethane, polycarbonate, and polystyrene, as long as they are resins capable of being extruded at 270° to 350° C. These resins to be blended may be of a single kind or two or more kinds. For example, polyethylene (6 weight %) and polypropylene (4 weight %) can be mixed with polyethylene terephthalate (90 weight %). The mixing ratio of polyester to the other resins is varied according to the kinds of the resins to be mixed. In case of polyolefins, it is suitably polyester/other resin=100/0 to 80/20 in terms of a weight ratio. The mixing ratio exceeding this range rapidly deteriorates the physical properties of the mixed resin. In case of the resins other than polyolefin, they are mixed preferably in the range of polyester/other resin=100/0 to 50/50, preferably 100/0 to 70/30 in terms of a weight ratio.

There can be enumerated as the white pigment mixed and dispersed in polyester on the reflective support according to the present invention, an inorganic pigment such as titanium dioxide, barium sulfate, lithopon, aluminium oxide, calcium carbonate, silicon oxide, antimony trioxide, titanium phosphate, zinc oxide, white lead, and zirconium oxide, and a fine powder of an organic compound such as polystyrene and a styrene-divinylbenzene copolymer.

Among these pigments, the use of titanium dioxide is particularly effective. Titanium dioxide may be either of a rutile type or an anatase type and may be manufactured either by a sulfate process or a chloride process. KA-10 and KA-20 manufactured by Titan Ind. Co., Ltd. and A-220 manufactured by Ishihara Sangyo Co., Ltd. can be enumerated as specific trade names.

The average particle size of the white pigment used is preferably 0.1 to 0.8 μm. A particle size of less than 0.1 μm makes it difficult to uniformly mix and disperse the pigment in a resin and therefore is not preferred. A particle size exceeding 0.8 μm not only makes it difficult to obtain a sufficient whiteness but also generates projections on coated faces and adversely affects image quality.

The mixing ratio of the white pigment to the above polyester is preferably 98/2 to 30/70 (polyester/white pigment), more preferably 95/5 to 50/50, and particularly preferably 90/10 to 60/40 in terms of a weight ratio. The white pigment of less than 2 weight % provides an insufficient contribution to the whiteness and the white pigment exceeding 70 weight % unfavorably reduces the smoothness and the glossiness on the surface of the support for a photographic printing paper.

The above polyester and white pigment are mixed and kneaded in a resin with a kneader such as a two rolls kneader, a three rolls kneader, or a Banbury mixer together with a dispersing aid such as a metal salt of a higher fatty acid, a higher fatty acid ethyl, a higher fatty acid amide, or a higher fatty acid. An anti-oxidation agent can also be incorporated into the resin layer. It can be added in the content of 50 to 1000 ppm based on the amount of the resin.

In the reflective support according to the present invention, the thickness of the polyester/white pigment composition coated on the emulsion-coated side of the substrate is 5 to 100 μm, preferably 5 to 80 μm, more preferably 10 to 50 μm. A thickness larger than 100 μm emphasizes the brittleness of the resin and causes problems relating to physical properties such as the generation of cracks. A thickness less than 5 μm not only damages the waterproof performance which is an original object for coating but also can not satisfy the whiteness and surface smoothness requirements at the same time and is not preferred since it makes the layer physically too soft.

The thickness of the resin or resin composition coated on the substrate surface on which an emulsion is not coated is preferably 5 to 100 μm, more preferably 10 to 50 μm. A thickness exceeding this range emphasizes the brittleness of the resin and causes problems relating to physical properties such as the generation of cracks. A thickness less than this range not only damages the waterproof performance which is an original object for coating but also makes the layer physically too soft and is not preferred. Polyester is preferred as the above resin. Among them, polyester containing polyethylene terephthalate as a main component is preferred. A melting and extruding lamination process can be enumerated as the method for coating an emulsion-coated face-covering layer and a back face layer on a substrate.

The substrate used for the reflective support according to the present invention is selected from the materials generally used for a photographic printing paper. That is, there is used the base paper for which a natural pulp selected from a coniferous tree and a broad-leaved tree and a synthetic pulp are used as a main raw material and to which there are added according to necessity, a filler such as clay, talc, calcium carbonate and a urea resin fine particle, a sizing agent such as rosin, an alkylketene dimer, higher fatty acid, epoxidized fatty acid amide, paraffin wax and alkenyl succinate, a paper strengthening agent such as starch, polyamidepolyamineepichlorohydrin and ployacrylamide, and a fixing agent such as alum sulfate and a cationic polymer.

The kind and thickness of the substrate are not specifically limited. The weight thereof is preferably 50 to 250 g/m$^2$. The substrate is preferably subjected to a surface treatment by applying heat and pressure by machine calender and supercalender for the purpose of improving the smoothness and flatness.

This "smoothness" is expressed with the surface roughness of the support as a standard. With respect to the surface roughness, a center line average surface roughness is used as the standard therefor. The center line average surface roughness is defined as follows: a portion with an area SM is taken out on a center face from a rough curve face; the rectangular coordinate axes, that is, an X axis and a Y axis are put on the center line of this portion taken out; the axis perpendicular to the center line is put as a Z axis; and then, the center line average surface roughness (SRa) is defined by the value obtained from the following equation and expressed in terms of a μm unit:

$$SRa = \frac{1}{SM} \int_0^{Lx} \int_0^{Ly} |f(X, Y)| dX \cdot dY$$

$$Lx\ Ly = SM$$
$$Z = f(X, Y)$$

The values of the center line average surface roughness and the height of a projection from the center line can be obtained by using, for example, a three dimensions surface roughness measuring device (SE-30H) manufactured by Kosaka Laboratory to measure an area of 5 mm$^2$ with a diamond needle having a diameter of 4 μm at a cutoff value of 0.8 mm, an enlarging magnification of 20 in the horizontal direction, and an enlarging magnification of 2000 in the height direction, wherein the proceeding speed of the measuring needle is preferably not much more than 0.5 mm/second.

Preferred is a support in which the value obtained by this measurement is 0.15 μm or less, further preferably 0.10 μm or less. The use of a support having such a surface roughness (smoothness) can provide a color print with a surface having an excellent smoothness.

Before coating the above mixed composition of the polyester and white pigment on a substrate, the substrate surface is preferably subjected to a pretreatment such as a corona discharge treatment, a flame treatment or a subbing treatment.

The use of polyester such as polyethylene terephthalate weakens the adhesion to a photographic emulsion in some cases as compared with polyethylene and accordingly, after polyester is laminated on the substrate by melting and extruding, the polyester surface is preferably subjected to the corona discharge treatment before providing a hydrophilic colloid layer thereon.

A subbing solution containing a compound represented by formula (U) is preferably coated on the surface of a thermoplastic resin containing polyester as a main component:

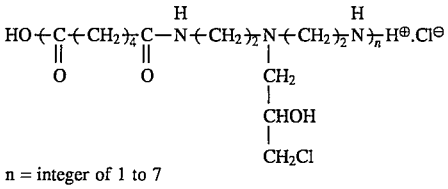

(U)

n = integer of 1 to 7

The coating amount of the compound represented by formula (U) is preferably 0.1 mg/m$^2$ or more, further preferably 1 mg/m$^2$ or more, and most preferably 3 mg/m$^2$ or more. The greater the coating amount is, the more the adhesion power can be strengthened. However, the excessive use thereof is disadvantageous in terms of cost.

Further, an alcohol such as methanol is preferably added in order to improve the coating aptitude of the subbing solution. In this case, the ratio of alcohol is preferably 20 weight % or more, further preferably 40 weight % or more, and most preferably 60 weight % or more. In order to further improve the coating aptitude, preferably used are various surface active agents such as anionic, cationic, amphoteric, fluorinated carbon series, and organic silicon series surfactants.

Further, a water soluble high-molecular weight compound such as gelatin is preferably added in order to obtain a good subbing coated surface.

The pH value of the solution is preferably 4 to 11, further preferably 5 to 10 in view of the stability of the compound of formula (U).

Before coating the above subbing solution, the thermoplastic resin surface is preferably subjected to a surface treatment. A corona discharge treatment, a flame treatment and a plasma treatment can be used for the surface treatment.

In coating the subbing solution, it can be coated by the methods generally known, such as a gravure coater, a bar coater, a dip coating method, an air knife coating method, a curtain coating method, a roller coating method, a doctor coating method, and an extrusion coating method.

The temperature for drying a coated layer is preferably 30° to 100° C., further preferably 50° to 100° C., and most preferably 70° to 100° C. The upper limit thereof is determined by the heat resistance of the resin and the lower limit thereof is determined by manufacturing efficiency.

To be specific, the cyan coupler of the present invention represented by formula (Ia) is represented by formulas (IIa) to (VIIIa):

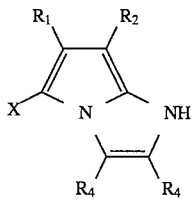

(IIa)

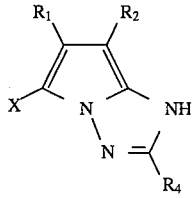

(IIIa)

-continued

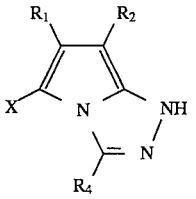

(IVa)

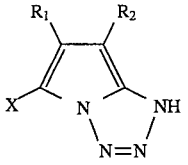

(Va)

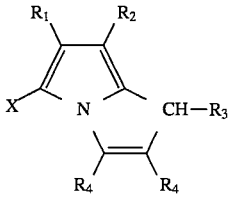

(VIa)

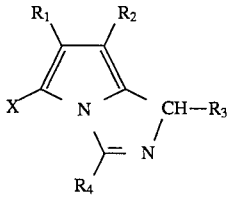

(VIIa)

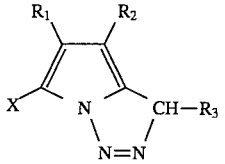

(VIIIa)

In formulas (IIa) to (VIIIa), $R_1$, $R_2$, $R_3$, $R_4$ and X have the same meanings as $R_1$, $R_2$, $R_3$, $R_4$ or X in formula (Ia), respectively.

In the present invention, the cyan coupler represented by formula (IIa), (IIIa) or (IVa) is preferred and the cyan coupler represented by formula (IIIa) is particularly preferred.

In the cyan coupler of the present invention, $R_1$, $R_2$ and $R_3$ each represents an electron attractive group having a Hammett's substituent constant $\sigma_p$ value of 0.20 or more, and the sum of the $\sigma_p$ values of $R_1$ and $R_2$ is 0.65 or more. The sum of the $\sigma_p$ values of $R_1$ and $R_2$ is preferably 0.70 or more and the upper limit thereof is not much more than 1.8.

$R_1$, $R_2$ and $R_3$ each represents an electron attractive group having a Hammett's substituent constant $\sigma_p$ value of 0.20 or more, preferably 0.35 or more, and more preferably 0.60 or more. The upper limit thereof is 1.0 or less. Hammett's Rule is an empirical rule which was proposed by L. P. Hammett in 1935 in order to quantitatively assess the effects a particular substituent exerts on the reactivity or equilibrium of a benzene derivative. Today, the propriety of Hammett's Rule is widely accepted.

The $\sigma_p$ value and $\sigma_m$ value are included in the substituent constant obtained according to Hammett's Rule and the values thereof are described in many general publications. They are described in, for example, "*Lange's Handbook of Chemistry*" 12th edition, edited by J. A. Dean, 1979 (McGraw-Hill) and "*Chemical Region, Extra Edition*" No. 122, pp. 96 to 103, 1979 (Nankohdo). In the present invention, $R_1$, $R_2$ and $R_3$ are regulated by the Hammett's substituent constant $\sigma_p$ value but this does not mean that they are limited to the substituents the $\sigma_p$ values of which are described in these publications. Even if the $\sigma_p$ value of a particular group is not described in the literature, that group is included in the scope of the present invention so long as its $\sigma_p$ value is included in the above range when it is measured according to Hammett's Rule.

There can be enumerated as specific examples of $R_1$, $R_2$ and $R_3$ which are electron attractive groups having $\sigma_p$ values of 0.20 or more, an acyl group, an acyloxy group, a carbamoyl group, an alkoxycarbonyl group, an aryloxycarbonyl group, a cyano group, a nitro group, a dialkylphosphono group, a diarylphosphono group, a diarylphosphinyl group, an alkylsulfinyl group, an arylsulfinyl group, an alkylsulfonyl group, an arylsulfonyl group, a sulfonyloxy group, an acylthio group, a sulfamoyl group, a thiocyanate group, a thiocarbonyl group, a halogenated alkyl group, a halogenated alkoxy group, a halogenated aryloxy group, a halogenated alkylamino group, a halogenated alkylthio group, an aryl group substituted with other electron attractive groups having $\sigma_p$ values of 0.20 or more, a heterocyclic group, a halogen atom, an azo group, and a selenocyanate group. Of these substituents, the groups capable of having further substituents may further have the substituents given for the groups enumerated for $R_4$ described later.

To explain $R_1$, $R_2$ and $R_3$ in more detail, there can be enumerated as electron attractive groups having $\sigma_p$ values of 0.20 or more, an acyl group (for example, acetyl, 3-phenylpropanoyl, benzoyl, and 4-dodecyloxybenzoyl), an acyloxy group (for example, acetoxy), a carbamoyl group (for example, carbamoyl, N-ethylcarbamoyl, N-phenylcarbamoyl, N,N-dibutylcarbamoyl, N-(2-dodecyloxyethyl)carbamoyl, N-(4-n-pentadecanamide)phenylcarbamoyl, N-methyl-N-dodecylcarbamoyl, and N-[3-(2,4-di-t-amylphenoxy)propyl]carbamoyl), an alkoxycarbonyl group (for example, methoxycarbonyl, ethoxycarbonyl, iso-propyloxycarbonyl, tert-butyloxycarbonyl, iso-butyloxycarbonyl, butyloxycarbonyl, dodecyloxycarbonyl, octadodecyloxycarbonyl, diethylcarbamoylethoxycarbonyl, perfluorohexylethoxycarbonyl, and 2-decylhexyloxycarbonylmethoxycarbonyl), an aryloxy-carbonyl group (for example, phenoxycarbonyl and 2,5-amylphenocycarbonyl), a cyano group, a nitro group, a dialkylphosphono group (for example, dimethylphosphono), a diarylphosphono group (for example, diphenylphosphono), a dialkoxyphospholyl group (for example, dimethoxyphospholyl), a diarylphosphinyl group (for example, diphenylphosphinyl), an alkylsulfinyl group (for example, 3-phenoxypropylsulfinyl), an arylsulfinyl group (for example, 3-pentadecylphenylsulfinyl), an alkylsulfonyl group (for example, methanesulfonyl and octanesulfonyl), an arylsulfonyl group (for example, benzenesulfonyl and toluenesulfonyl), a sulfonyloxy group (for example, methanesulfonyloxy and toluenesulfonyloxy), an acylthio group (for example, acetylthio and benzoylthio), a sulfamoyl group (for example, N-ethylsulfamoyl, N,N-dipropylsufamoyl, N-(2-dodecyloxyethyl)sulfamoyl, N-ethyl-N-dodecylsulfamoyl, and N,N-diethylsulfamoyl), a thiocyanate group, a thiocarbonyl group (for example, methylthiocarbonyl and phenylthiocarbonyl), a halogenated alkyl group (for example, trifluoromethyl and heptafluoropropyl), a halogenated alkoxy group (for example, trifluoromethyloxy), a halogenated aryloxy group (for example, pentafluorophenyloxy), a halogenated alkylamino group (for example, N,N-di-(trifluoromethyl) amino), a halogenated alkylthio group (for example, difluoromethyl and 1,1,2,2-tetrafluoroethylthio), an aryl group substituted with other electron attractive groups having $\sigma_p$ values of 0.20 or more (for example, 2,4-dinitrophenyl, 2,4,6-trichlorophenyl, and pentachlorophenyl), a heterocyclic group (for example, 2-benzoxazolyl, 2-benzothiazolyl, 1-phenyl-2-benzimidazolyl, pyrazolyl, 5-chloro- 1-tetra-azolyl, and 1-pyrrolyl), a halogen atom (for example, a chlorine atom and a bromine atom), an azo group (for example, phenylazo), and a selenocyanate group.

To enumerate the representative $\sigma_p$ values of the electron attractive groups, they are a cyano group (0.66), a nitro group (0.78), a trifluoromethyl group (0.54), an acetyl group (0.50), a trifluoromethanesulfonyl group (0.92), a methanesulfonyl group (0.72), a benzenesulfonyl group (0.70), a methanesulfinyl group (0.49), a carbamoyl group (0.36), a methoxycarbonyl group (0.45), a pyrazolyl group (0.37), a methanesulfonyloxy group (0.36), a dimethoxyphospholyl group (0.60), and a sulfamoyl group (0.57).

There can be enumerated as the preferred $R_1$, $R_2$ and $R_3$, an acyl group, an acyloxy group, a carbamoyl group, an alkoxycarbonyl group, an aryloxycarbonyl group, a cyano group, a nitro group, an alkylsulfinyl group, an arylsulfinyl group, an alkylsulfonyl group, an arylsulfonyl group, a sulfamoyl group, a halogenated alkyl group, a halogenated alkoxy group, a halogenated alkylthio group, a halogenated aryloxy group, a halogenated aryl group, an aryl group substituted with two or more nitro groups, and a heterocyclic group. More preferred are an acyl group, an alkoxycarbonyl group, an aryloxycarbonyl group, a nitro group, a cyano group, an arylsulfonyl group, a carbamoyl group, and a halogenated alkyl group. Still more preferred are a cyano group, an alkoxycarbonyl group, an aryloxycarbonyl group, and a halogenated alkyl group.

Particularly preferred are an alkoxycarbonyl group substituted with a cyano group, a fluorine atom, an alkoxycarbonyl group, or a carbamoyl group, or an alkoxycarbonyl group having a straight chain, a branched chain or an ether bond, and an unsubstituted or an alkyl group- or alkoxy group-substituted aryloxycarbonyl group.

The combination of $R_1$ and $R_2$ is preferably that $R_1$ is a cyano group and $R_2$ is an alkoxycarbonyl group substituted with a fluorine atom, an alkoxycarbonyl group or a carbamoyl group or an alkoxycarbonyl group having a straight chain, a branched chain or an ether bond, or an unsubstituted or an alkyl group- or alkoxy group-substituted aryloxycarbonyl group.

$R_4$ represents a hydrogen atom or a substituent (including an atom), and there can be enumerated as the substituent, a halogen atom, an aliphatic group, an aryl group, a heterocyclic group, an alkoxy group, an aryloxy group, a heterocyclic oxy group, an alkyl, aryl or heterocyclic thio group, an acyloxy group, a carbamoyloxy group, a silyloxy group, a sulfonyloxy group, an acylamino group, an alkylamino group, an arylamino group, a ureido group, a sulfamoylamino group, an alkenyloxy group, a formyl group, an alkyl, aryl or heterocyclic acyl group, an alkyl, aryl or heterocyclic sulfonyl group, an alkyl, aryl or heterocyclic sulfinyl group, an alkyl, aryl or heterocyclic oxycarbonyl group, an alkyl, aryl or heterocyclic oxycarbonylamino group, a sulfonamide group, a carbamoyl group, a sulfamoyl group, a phosphonyl group, a sulfamide group, an imide group, an azolyl group, a hydroxy group, a cyano group, a carboxy group, a nitro group, a sulfo group, and an unsubstituted amino group. The alkyl group, aryl group or heterocyclic group contained in these groups may further be substituted with the substituents exemplified for $R_4$.

To be more detailed, $R_4$ represents a hydrogen atom, a halogen atom (for example, a chlorine atom and a bromine atom), an aliphatic group (for example, a linear or branched alkyl group having a carbon number of 1 to 36, an aralkyl group, an alkenyl group, an alkynyl group, a cycloalkyl group, and a cycloalkenyl group, and to be detailed, for example, methyl, ethyl, propyl, isopropyl, t-butyl, tridecyl, 2-methanesulfonylethyl, 3-(3-pentadecylphenoxy)propyl, 3-[4-{ 2-[4-(4-hydroxyphenylsulfonyl)phenoxy] dodecanamide}phenyl]propyl, 2-ethoxytridecyl, trifluoromethyl, cyclopentyl, and 3-(2,4-di-t-amylphenoxy)propyl), an aryl group (preferably having a carbon number of 6 to 36, for example, phenyl, naphthyl, 4-hexadecyloxyphenyl, 4-t-butylphenyl, 2,4-di-t-amylphenyl, 4-tetradecanamidephenyl, and 3-(2,4-tert-amylphenoxyacetoamide)phenyl), a heterocyclic group (for example, 3-pyridyl, 2-furyl, 2-thienyl, 2-pyridyl, 2-pyrimidinyl, and 2-benzothiazolyl), an alkoxy group (for example, methoxy, ethoxy, 2-methoxyethoxy, 2-dodecyloxyethoxy, and 2-methanesulfonylethoxy), an aryloxy group (for example, phenoxy, 2-methylphenoxy, 4-tert-butylphenoxy, 2,4-di-tert-amylphenoxy, 2-chlorophenoxy, 4-cyanophenoxy, 3-nitrophenoxy, 3-t-butyloxycarbamoylphenoxy, and 3-methoxycarbamoylphenoxy), a heterocyclic oxy group (for example, 2-benzimidazolyloxy, 1-phenyltetrazole-5-oxy, and 2-tetrahydropyranyloxy), an alkyl, aryl or heterocyclic thio group (for example, methylthio, ethylthio, octylthio, tetradecylthio, 2-phenoxyethylthio, 3-phenoxypropylthio, 3-( 4-tert-butylphenoxy)propylthio, phenylthio, 2-butoxy-5-tert-octyolphenylthio, 3-pentadecylphenylthio, 2-carboxyphenylthio, 4-tetradecaneamidephenylthio, 2-benzothiazolylthio, 2,4-di-phenoxy-l, 3,4-triazole-6-thio, and 2-pyridylthio), an acyloxy group (for example, acetoxy and hexadecanoyloxy), a carbamoyloxy group (for example, N-ethylcarbamoyloxy and N-phenylcarbamoyloxy), a silyloxy group (for example, trimethylsilyloxy and dibutylmethylsilyloxy), a sulfonyloxy group (for example, dodecylsulfonyloxy), an acylamino group (for example, acetoamide, benzamide, tetradecaneamide, 2-(2,4-tert-amylphenoxy)acetoamide, 2-[4-( 4-hydroxyphenylsulfonyl)phenoxy]decaneamide, isopentadecaneamide, 2-(2,4-di-t-amylphenoxy)butaneamide, and 4-(3-t-butyl-4-hydroxyphenoxy)butaneamide), an alkylamino group (for example, methylamino, butylamino, dodecylamino, dimethylamino, diethylamino, and methylbutylamino), an arylamino group (for example, phenylamino, 2-chloroanilino, 2-chloro-5-tetradecaneamideanilino, N-acetylanilino, 2-chloro- 5-[α-2-tert-butyl-4-hydroxyphenoxy)docaneamide] anilino, and 2-chloro-5-dodecyloxycarbonylanilino), a ureido group (for example, methylureido, phenylureido, N,N-dibutylureido, and dimethylureido), a sulfamoylamino group (for example, N,N-dipropylsulfamoylamino and N-methyl-N-decylsulfamoylamino), an alkenyloxy group (for example, 2-propenyloxy), a formyl group, an alkyl, aryl or heterocyclic acyl group (for example, acetyl, benzoyl, 2,4-di-tert-amylphenylacetyl, 3-phenylpropanoyl, and 4-dodecyloxybenzoyl), an alkyl, aryl or heterocyclic sulfonyl group (for example, methanesulfonyl, octanesulfonyl, benzenesulfonyl, and toluenesulfonyl), an alkyl, aryl or heterocyclic sulfinyl group (for example, octanesulfinyl, dodecanesulfinyl, phenylsulfinyl, 3-pentadecylphenylsulfinyl, and 3-phenoxypropylsulfinyl), an alkyl, aryl or heterocyclic oxycarbonyl group (for example, methoxycarbonyl, butoxycarbonyl, dodecyloxycarbonyl, octadecyloxycarbonyl, phenyloxycarbonyl, and 2-pentadecyloxycarbonyl), an alkyl, aryl or heterocyclic oxycarbonylamino group (for example, methoxycarbonylamino, tetradecyloxycarbonylamino, phenoxycarbonylamino, and 2,4-di-tert-butylphenoxycarbonylamino), a sulfonamide group (for example, methanesulfonamide, hexadecanesulfonamide, benzenesulfonamide, p-toluenesulfonamide, octadecanesulfonamide, and 2-methoxy-5-tert-butylbenzenesulfonamide), a carbamoyl group (for example, N-ethylcarbamoyl, N,N-dibutylcarbamoyl, N-(2-dodecyloxyethyl)carbamoyl, N-methyl-N-dodecylcarbamoyl, and- N-[3-(2,4-di-tert-amylphenoxy)propyl]carbamoyl), a sulfamoyl group (for example, N-ethylsulfamoyl, N,N-dipropylsulfamoyl, N-(2-dodecyloxyethyl)sulfamoyl, N-ethyl-N-dodecylsulfamoyl, and N,N-diethylsulfamoyl), a phosphonyl group (for example, phenoxyphosphonyl, octyloxyphosphonyl, and phenylphosphonyl), a sulfamide group (for example, dipropylsulfamoylamino), an imide group (for example, N-succinimide, hydantoinyl, N-phthalimide, and 3-octadecenylsuccinimide), an azolyl group (for example, imidazolyl, pyrazolyl, 3-chloro-pyrazole-1-yl, and triazolyl), a hydroxy group, a cyano group, a carboxy group, a nitro group, a sulfo group, and an unsubstituted amino group.

There can be preferably enumerated as $R_4$, an alkyl group, an aryl group, a heterocyclic group, a cyano group, a nitro group, an acylamino group, an arylamino group, a ureido group, a sulfamoylamino group, an alkylthio group, an arylthio group, a heterocyclic thio group, an alkoxycarbonylamino group, an aryloxycarbonylamino group, a sulfonamide group, a carbamoyl group, a sulfamoyl group, a sulfonyl group, an alkoxycarbonyl group, an aryloxycarbonyl group, a heterocyclic oxy group, an acyloxy group, a carbamoyloxy group, an imide group, a sulfinyl group, a phosphonyl group, an acyl group, and an azolyl group.

Further preferred are an alkyl group and an aryl group. More preferred is an alkyl group or aryl group having at least one alkoxy group, sulfonyl group, sulfamoyl group, carbamoyl group, carbamide group, or sulfonamide group as a substituent. Particularly preferred is an aryl group having an alkoxy group or alkylamino group at the o-position. An aryl group having an alkoxy group is most preferred. The alkyl residue of the alkoxy group may be a straight-chain alkyl group or a branched alkyl group which may have one or more substituents. Specific examples of the alkyl residue include methyl, ethyl, hexyl, 2-ethylhexyl, octyl, and benzyl, but the present invention is not limited thereto.

The alkylamino group may be a monoalkylamino group or a dialkylamino group. The alkyl residue of the alkylamino group may be a straight-chain alkyl group or a branched alkyl group which may have one or more substituents. Specific examples of the alkylamino group include a monomethylamino group, a dimethylamino group, a diethylamino group, etc., but the present invention is not limited thereto.

The aryl group having an alkoxy group or alkylamino group at the o-position may further have other substituent(s) such as an aliphatic or aromatic acylamide or sulfonamide group and a halogen atom.

In formula (Ia), X represents a hydrogen atom or a group (hereinafter referred to as a splitting group) which is split off when the coupler reacts with an oxidation product of an organic primary amine color developing agent. When X represents a splitting group, the splitting group is a halogen atom, an aromatic azo group, an alkyl group, aryl group, heterocyclic group, alkyl- or arylsulfonyl group, arylsulfinyl group, alkoxy, aryloxy or heterocyclic oxy carbonyl group, alkyl, aryl or heterocyclic carbonyl group, alkyl, aryl or heterocyclic aminocarbonyl group each bonded to a coupling site via an oxygen, nitrogen, sulfur or carbon atom, or a heterocyclic group bonded to the coupling site via a nitrogen atom in the heterocycle. There are included, for example, a halogen atom, an alkoxy group, an aryloxy group, an acyloxy group, an alkyl- or arylsulfonyloxy group, an acylamino group, an alkyl- or arylsulfonamide group, an alkoxycarbonyloxy group, an aryloxycarbonyloxy group, an alkyl, aryl or heterocyclic thio group, a carbamoylamino group, an arylsulfinyl group, an arylsulfonyl group, a 5-membered or 6-membered nitrogen-containing heterocyclic group, an imide group, and an arylazo group. The alkyl group, aryl group or heterocyclic group contained in these splitting groups may further be substituted with the substitutents enumerated for $R_4$. When there are two or more of these substituents, they may be the same or different. These groups may further have the substituents enumerated for $R_4$.

To be more detailed, the splitting group is a halogen atom (for example, a fluorine atom, a chlorine atom and a bromine atom), an alkoxy group (for example, ethoxy, dodecyloxy, methoxyethylcarbamoylmethoxy, carboxypropyloxy, methylsulfonylethoxy, and ethoxycarbonylmethoxy), an aryloxy group (for example, 4-methylphenoxy, 4-chlorophenoxy, 4-methoxyphenoxy, 4-carboxyphenoxy, 3-ethoxycarboxyphenoxy, 3-acetylaminophenoxy, and 2-carboxyphenoxy), an acyloxy group (for example, acetoxy, tetradecanoyloxy, and benzolyoxy), an alkyl- or arylsulfonyloxy group (for example, methanesulfonyloxy and toluenesulfonyloxy), an acylamino group (for example, dicholoracetylamino and heptafluorobutylylamino), an alkyl- or arylsulfonamide group (for example, methanesulfonamide, trifluoromethanesulfonamide, and p-tolunesulfonylamino), an alkoxycarbonyloxy group (for example, ethoxycarbonyloxy and benzyloxycarbonyloxy), an aryloxycarbonyloxy group (for example, phenoxycarbonyloxy), an alkyl, aryl or heterocyclic thio group (for example, ethylthio, 2-carboxyethylthio, dodecylthio, 1-carboxydodecylthio, phenylthio, 2-butoxy-5-t-octylphenylthio, and tetrazolylthio), an arylsulfonyl group (for example, 2-butoxy-5-tert-octylphenylsulfonyl), an arylsulfinyl group (for example, 2-butoxy-5-tert-octylphenylsulfinyl), a carbamoylamino group (for example, N-methylcarbamoylamino and N-phenylcarbamoylamino), a 5-membered or 6-membered nitrogen-containing heterocyclic group (for example, imidazolyl, pyrazolyl, triazolyl, tetrazolyl, and 1,2-dihydro-2-oxo-1-pyridyl), an imide group (for example, succinimide and hydantoinyl), and an arylazo group (for example, phenylazo and 4-methoxyphenylazo). These groups may further be substituted with the substitutents enumerated for $R_4$. There is available as a splitting group bonded via a carbon atom, a bis type coupler which can be obtained by condensing a tetraequivalent coupler with aldehydes and ketones. The splitting group according to the present invention may contain photographically useful groups such as a development inhibitor and a development accelerator.

X is preferably a halogen atom, an alkoxy group, an aryloxy group, an alkyl- or arylthio group, an arylsulfonyl group, an arylsulfinyl group, or a 5-membered or 6-membered nitrogen-containing heterocyclic group bonded to a coupling active site via a nitrogen atom. X is more preferably an arylthio group.

In the cyan coupler represented by formula (Ia), the group represented by $R_1$, $R_2$, $R_3$, $R_4$ or X may contain a cyan coupler residue represented by formula (Ia) to form a polymer higher than a dimer, or the group represented by $R_1$, $R_2$, $R_3$, $R_4$ or X may contain a high molecular chain to form a homopolymer or a copolymer. The homopolymer or copolymer containing the high molecular chain is an addition polymer having the cyan coupler residue represented by formula (Ia), and a typical example thereof is a homopolymer or copolymer of an ethylene type unsaturated compound. In this case, one or more kinds of a cyan color-forming repetitive unit having a cyan coupler residue represented by formula (Ia) may be contained in the polymer and it may be a coupler containing one or more kinds of a non-color developable ethylene type monomer such as acrylic acid ester, methacrylic acid ester, and maleic acid ester, which is not subjected to a coupling with the oxidation product of an aromatic primary amine developing agent, as a copolymerization component.

Specific examples of the coupler of the present invention are shown below but the present invention is not limited thereto.

(1)
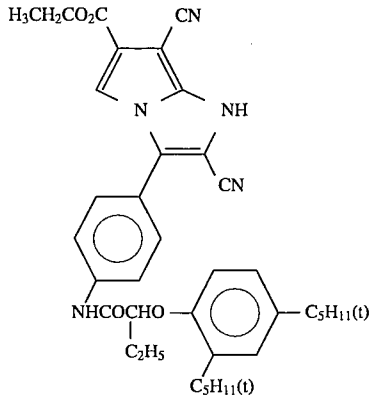
(2)
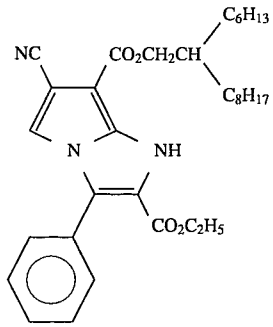

-continued
(3)
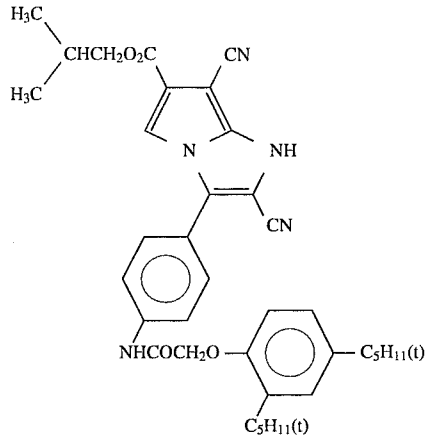
(4)
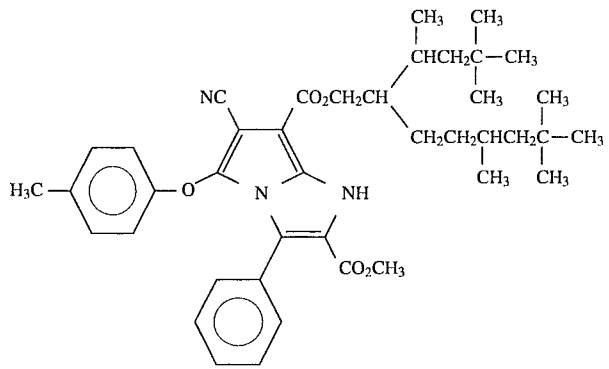

-continued
(5)
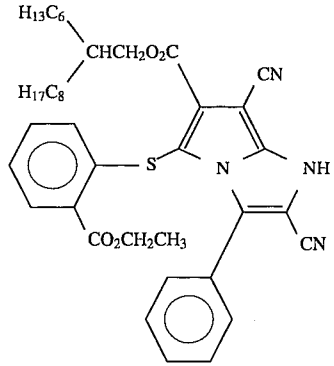
(6)
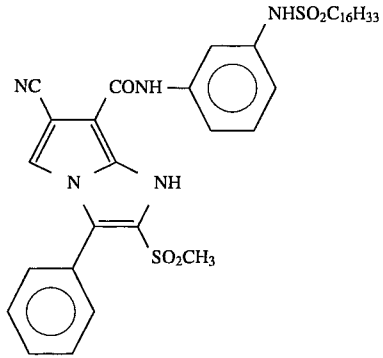
(7)
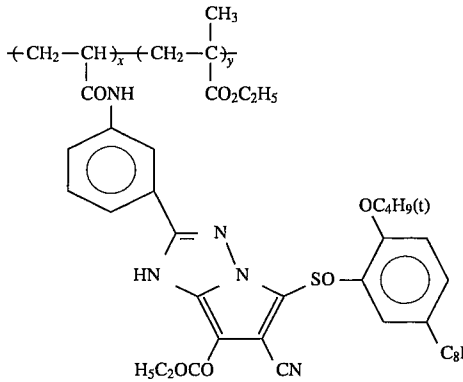
x:y = 50:50 (molar ratio)

-continued
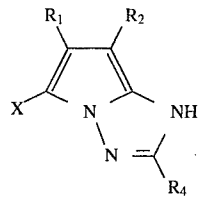
| No. | $R_1$ | $R_2$ | $R_4$ | X |
|---|---|---|---|---|
| 8 | $CO_2CH_3$ | CN | 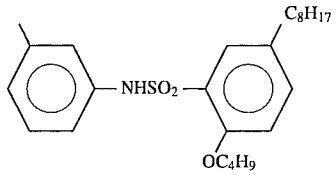 | H |
| 9 | CN | 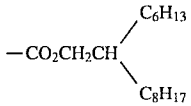 | 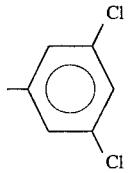 | H |
| 10 | CN | 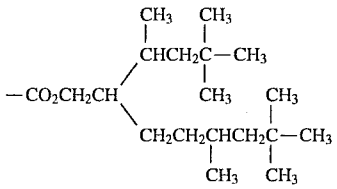 | 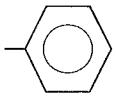 | H |
| 11 | CN | 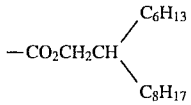 | 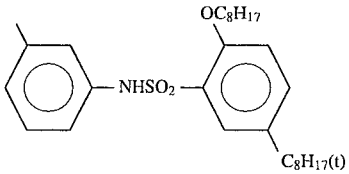 | H |

-continued
| | | | | |
|---|---|---|---|---|
| 12 | CN | 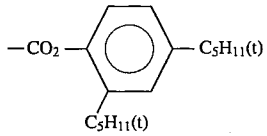 | 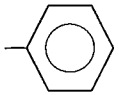 | H |
| 13 | CN | 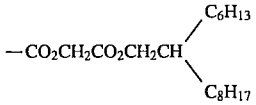 | 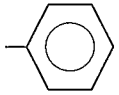 | H |
| 14 | CN | $-CO_2CH_2CH_2(CF_2)_6F$ | 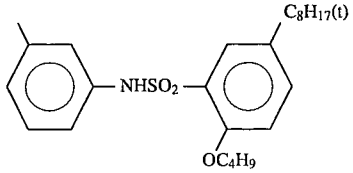 | H |
| 15 | CN | 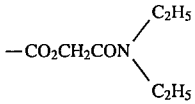 | 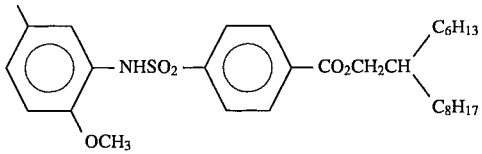 | 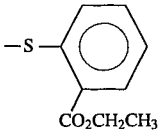 |
| 16 | CN | $-CO_2CH_2CH_2(CF_2)_6F$ | 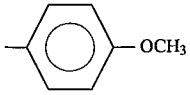 | 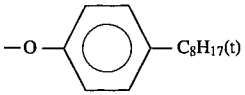 |
| 17 | CN | 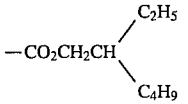 | 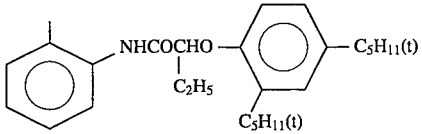 | 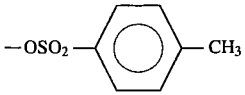 |
| 18 | CN | 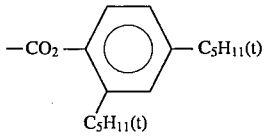 | 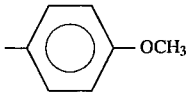 | 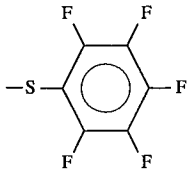 |

-continued
| | | | | |
|---|---|---|---|---|
| 19 | CN | $-CO_2CH_2CH(CH_3)_2$ | $-NHCONH-C_6H_3(NHSO_2C_{16}H_{33})(Cl)$ | 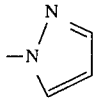 |
| 20 | CN | $-CO_2CH_2(CF_2)_4H$ | $-NHCOCH(C_6H_{13})-C_6H_3(C_5H_{11}(t))(C_5H_{11}(t))$ | 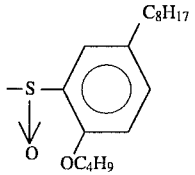 |
| 21 | CN | $-CO_2CH_2CH(C_8H_{17})(C_6H_{13})$ | 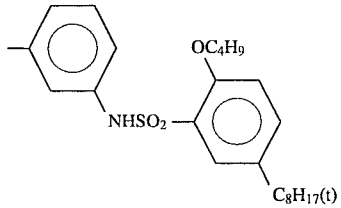 | Cl |
| 22 | 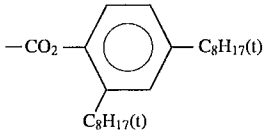 | CN | $-C(CH_3)_3$ | 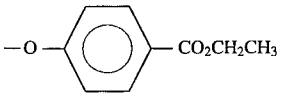 |
| 23 | $-CO_2CH_2C_6F_{13}$ | CN | 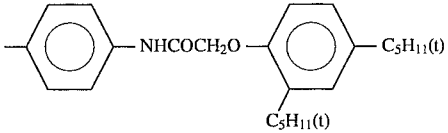 | Cl |
| 24 | 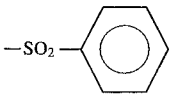 | 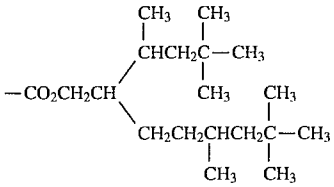 | $CH_3$ | $-OCOCH_3$ |

-continued
| | | | | |
|---|---|---|---|---|
| 25 | CN | $-CO_2CH_2CO_2CH_3$ | 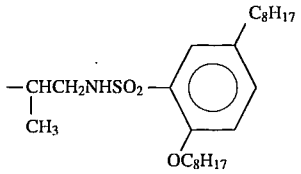 | 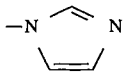 |
| 26 | CN | 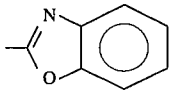 | 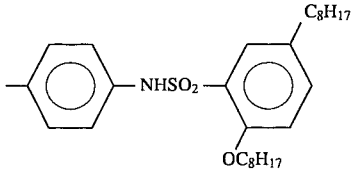 | 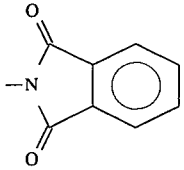 |
| 27 | CN | $CF_3$ | 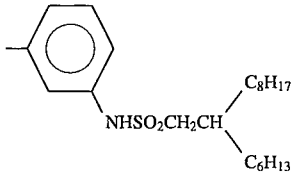 | Cl |
| 28 | 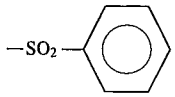 | $CF_3$ | 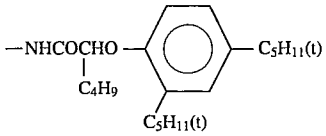 | F |
| 29 | CN | 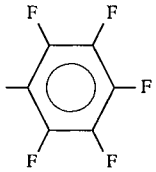 | 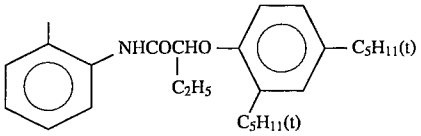 | 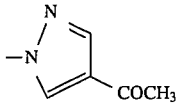 |
| 30 | 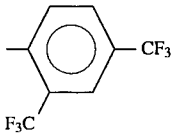 | 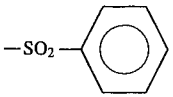 | 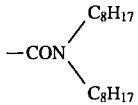 | 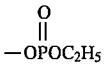 |

-continued
| | | | | |
|---|---|---|---|---|
| 31 | CN | 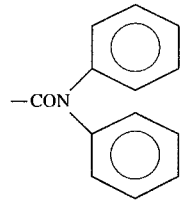 | 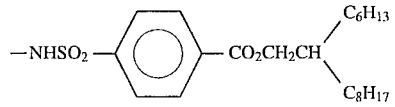 | 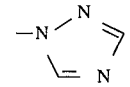 |
| 32 | CN | 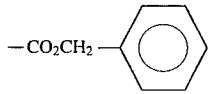 | 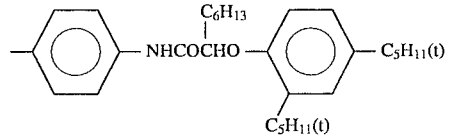 | H |
| 33 | CN | 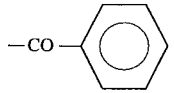 | 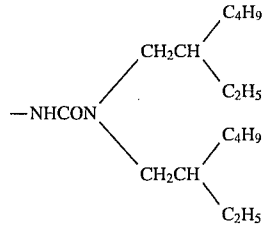 | $-OSO_2CH_3$ |
| | | 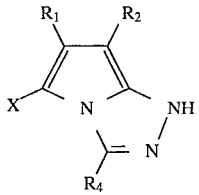 | | |
| 34 | $-CO_2C_2H_5$ | CN | 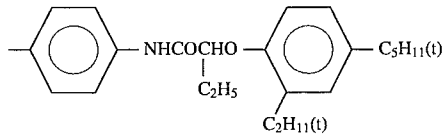 | Cl |

-continued
| | | | | |
|---|---|---|---|---|
| 35 | CN | $-CO_2CH_2CH(C_6H_{13})(C_8H_{17})$ | 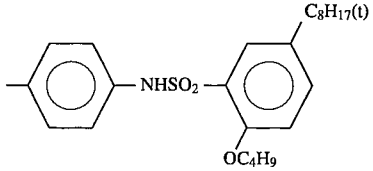 | H |
| 36 | CN | $-CO_2CH_2CH_2(CF_2)_6F$ | 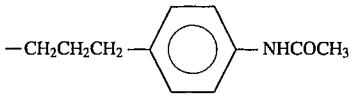 | 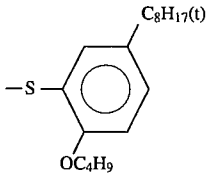 |
| 37 | CN | 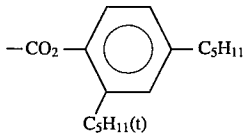 | 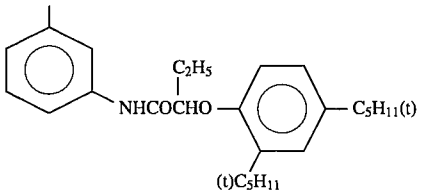 | 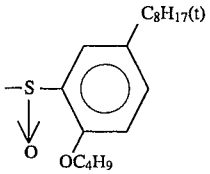 |
| 38 | CN | 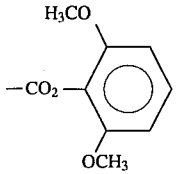 | 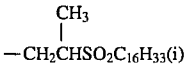 | 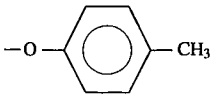 |
| 39 | CN | 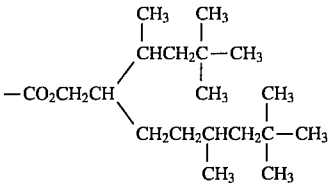 | 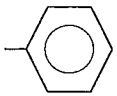 | H |

-continued
| | | | | |
|---|---|---|---|---|
| 40 | CN | $-CO_2CH(CH_3)_2$ | 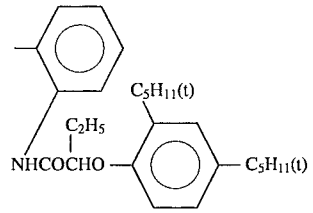 | Cl |
| 41 | CN | $-CON(C_2H_5)_2$ | 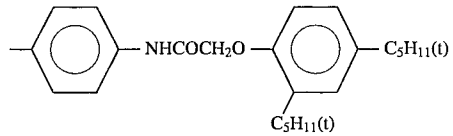 | $-OSO_2CH_3$ |
| (42) | 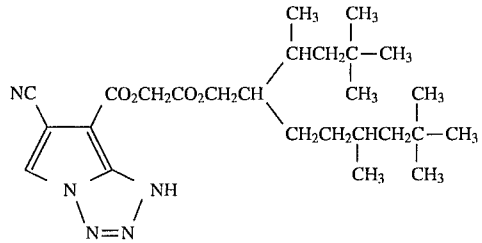 | | | |
| (43) | 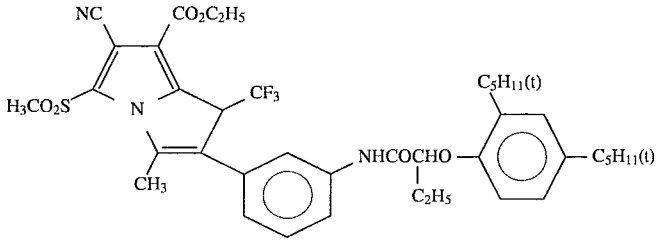 | | | |

-continued
(44)
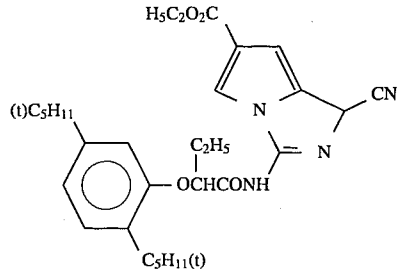
(45)
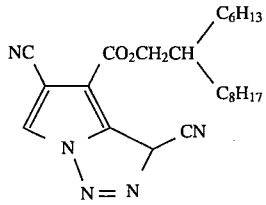
(46)
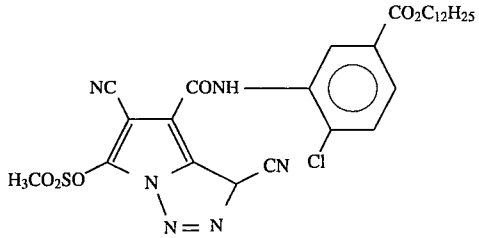
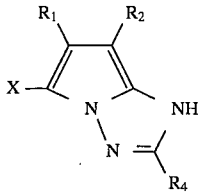

-continued
| No. | $R_1$ | $R_2$ | $R_4$ | X |
|---|---|---|---|---|
| 47 | CN | $-COOC_{14}H_{29}$(sec) | 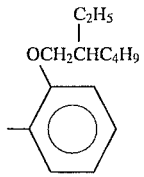 | Cl |
| 48 | CN | $-COOC_{14}H_{29}$(sec) | 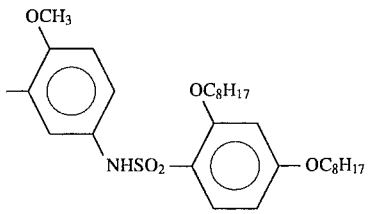 | Cl |
| 49 | CN | $-COOC_{14}H_{29}$(sec) | 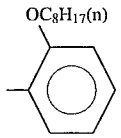 | Cl |

-continued
| | | | | |
|---|---|---|---|---|
| 50 | CN | $-COOC_{14}H_{29}$(sec) | 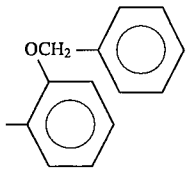 | Cl |
| 51 | CN | $-COOC_{14}H_{29}$(sec) | 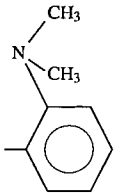 | Cl |
| 52 | CN | $-COOC_{16}H_{33}$(iso) | 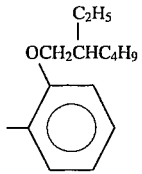 | Cl |

The compounds of the present invention and intermediate products thereof can be synthesized by known methods. They can be synthesized according to the methods described in, for example, *J. Am. Chem. Soc., No.* 80, 5332 (1958), *J. Am. Chem. Soc.,* No. 81, 2452 (1959), *J. Am. Chem. Soc.,* No. 112, 2465 (1990), *Org. Synth.,* I, 270 (1941), *J. Chem. Soc.,* 5149 (1962), *Heterocycles,* No. 27, 2301 (1988), and *Rec. Trav. Chim.,* 80, 1075 (1961), the publications cited therein, or the methods equivalent thereto.

Next, specific sysnthesis examples will be shown.

Synthetic example 1: Synthesis of exemplified compound (9)

The exemplified compound (9) was synthesized via the following route:

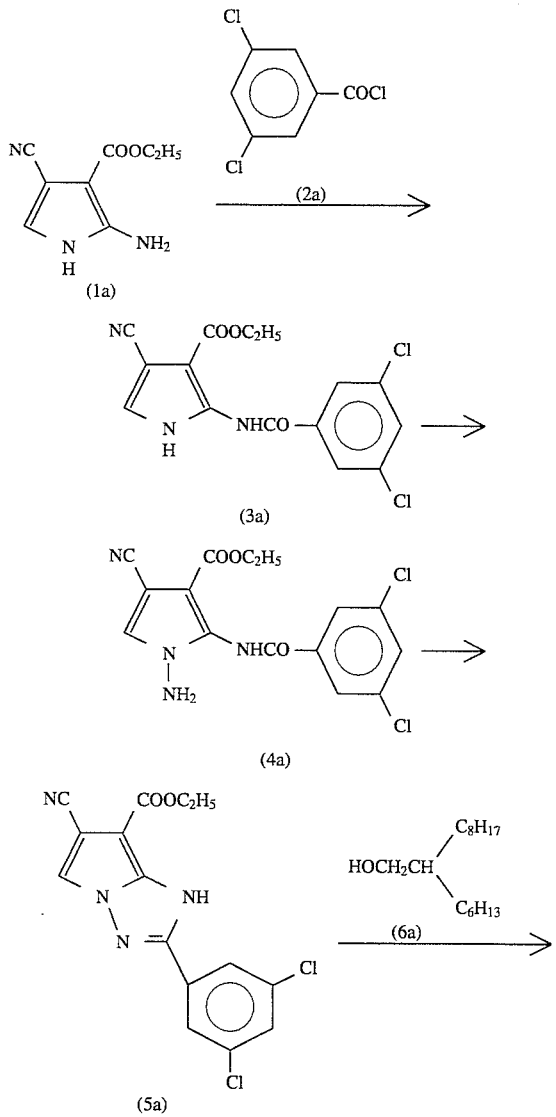

-continued

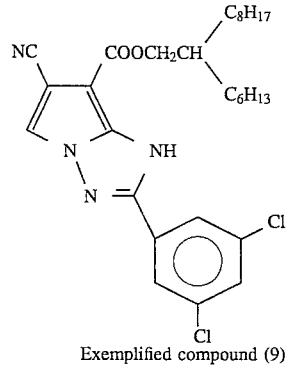

Exemplified compound (9)

Added to a dimethylacetamide (300 ml) solution of 2-amino- 4-cyano-3-methoxycarbonylpyrrole (la) (66.0 g, 0.4 mole) was 3,5-dichlorobenzoyl chloride (2a) (83.2 g, 0.4 mole) at room temperature, and stirring was applied for 30 minutes. Water was added and the solution was extracted twice with ethyl acetate. The organic layer was collected and washed with water and a saturated salt aqueous solution, followed by drying on anhydrous sodium sulfate. The solvent was distilled off under reduced pressure and the residue was recrystallized from acetonitrile (300 ml), whereby the compound (3a) (113 g, 84%) was obtained.

A powder of potassium hydroxide (252 g, 4.5 mole) was added to a dimethylformamide (200 ml) solution of the compound (3a) (101.1 g, 0.3 mole) at room temperature and stirred well. While cooling with water, hydroxylamine-o-sulfonic acid (237 g, 2.1 mole) was added little by little taking care so that the temperature did not suddenly rise, and after completing the addition, the solution was stirred for 30 minutes. A 0.1N hydrochloric acid aqueous solution was dropped to neutralize the solution checking with a pH test paper. The solution was extracted three times with ethyl acetate. The organic layer was washed with water and a saturated salt aqueous solution and then dried on anhydrous sodium sulfate. The solvent was distilled off under reduced pressure and the residue was refined with a column chromatography (spreading solvent, hexane:ethyl acetate=2:1), whereby the compound (4a) (9.50 g, 9%) was obtained.

Carbon tetrachloride (9 ml) was added to an acetonitrile (30 ml) solution of the compound (4a) (7.04 g, 20 mmole) at room temperature and subsequently triphenyl phosphine (5.76 g, 22 mmole) was added, followed by heating at reflux for 8 hours. After cooling down, water was added and the solution was extracted with ethyl acetate three times. The organic phase was washed with water and a saturated salt aqueous solution and then dried on sodium sulfate anhydrous. The solvent was distilled off under reduced pressure and the residue was refined with a silica gel column chromatography (spreading solvent, hexane:ethyl acetate=4:1), whereby the compound (5a) (1.13 g, 17%) was obtained.

The compound (Sa) thus obtained (1.8 g) and the compound (6a) (12.4 g) were dissolved in sulfolane (2.0 ml) and further titanium isopropoixde (1.5 g) was added thereto. The reaction was carried out for 1.5 hours while maintaining the reaction temperature at 110° C. and then ethyl acetate was added, followed by washing with water. After the ethyl acetate layer was dried, the solvent was distilled off and the residue was refined with a column chromatography, whereby the desired exemplified compound (9) (1.6 g) was obtained. The melting point thereof was 97° to 98° C.

In the case where the cyan coupler of the present invention represented by formula (Ia) is applied to a silver halide color light-sensitive material, the material may have at least one layer containing the coupler of the present invention on a support. The layer containing the coupler of the present invention may be a hydrophilic layer provided on the support. In general, the color light-sensitive material can be of the constitution in which a blue-sensitive silver halide emulsion layer, a green-sensitive silver halide emulsion layer, and a red-sensitive silver halide emulsion layer are coated in this order on a support but the order may be different from this. Further, at least one of the above light-sensitive emulsion layers can be replaced with an infrared-sensitive silver halide emulsion layer. The silver halide emulsions having the sensitivities in the respective wavelength regions and the couplers forming the dyes having the relationship of a complementary color with the rays to which the emulsions are sensitive can be allowed to be contained in these light-sensitive emulsions to carry out a color reproduction by a subtractive color process. It is provided, however, that there may be used a constitution in which the light-sensitive emulsion layers have no such the relationship as mentioned above with the hues of the dyes developed with the couplers.

In the case where the coupler of the present invention represented by formula (Ia) is applied to the light-sensitive material, it is used particularly preferably for a red-sensitive silver halide emulsion layer.

The addition amount of the coupler of the present invention to a light-sensitive material is usually $1\times10^{-3}$ to 1 mole, preferably $2\times10^{-3}$ to $5\times10^{-1}$ mole per mole of silver halide.

In the cyan coupler according to the present invention, the color difference between a cyan color developing portion and a minimum density portion at a cyan image density of 0.4 is preferably 23 or more, more preferably 24 or more.

The color difference mentioned herein between the color developing portion and the minimum density portion can be obtained by measuring the spectral absorptions at the cyan color patches and a background which are obtained by providing a photographic constitutional layer including a silver halide emulsion layer containing a cyan coupler on a reflection support having a smooth surface and then subjecting it to an exposure with a light having a suitable spectral composition and to a development. The spectral absorption is measured at the condition c of the geometrical conditions for lighting and receiving of light in JIS Z-8722 (1982) and by obtaining the three stimulus values X, Y and Z under the $D^{65}$ light source according to the method described in JIS Z-8722 (1982), then the respective L*a*b* values according to the method described in JIS Z-8729 (1980) and further the color difference according to the method described in JIS Z-8730 (1980).

In the silver halide color photographic light-sensitive material of the present invention, at least one compound selected from the lipophilic compounds represented by the following Formulas (A), (B) and (C) is preferably incorporated into a cyan coupler-containing silver halide emulsion layer, which compound is chemically combined with an aromatic primary amine developing agent at the condition of pH 8 or lower to form a substantially colorless product, and/or at least one compound selected from the lipophilic compounds represented by the following formula (D), which compound is chemically combined with an oxidation product of an aromatic primary amine developing agent at the condition of pH 8 or lower to form a substantially colorless product:

$$R_{a1}-L_{a1}-\overset{\overset{Z_{a1}}{\|}}{C}-Z_{a2} \qquad (A)$$

wherein $L_{a1}$ represents a single bond, —O—, —S—, —CO—, or —N($R_{a2}$)—; $R_{a1}$ and $R_{a2}$ may be the same or different and each represents an aliphatic group, an aromatic group, or a heterocyclic group, and $R_{a2}$ further represents a hydrogen atom, an acyl group, a sulfonyl group, a carbamoyl group, or a sulfamoyl group; $Z_{a1}$ represents an oxygen atom or a sulfur atom; $Z_{a2}$ represents a hydrogen atom, —O—$R_{a3}$, —S—$R_{a4}$, —$L_{a2}$— C(=$Z_{a1}$,)$R_{a5}$, or a heterocyclic group bonding via a nitrogen atom; $R_{a3}$ and $R_{a4}$ may be the same or different and each represents a vinyl group which may have a substituent, an aromatic group, or a heterocyclic group; $L_{a2}$ represents —O— or —S—; $Z_{a1}$, has the same meaning as $Z_{a1}$; $R_{a5}$ represents an aliphatic group, an aromatic group, or a heterocyclic group; and at least two of $R_{a1}$, $R_{a2}$ and $Z_{a2}$ may be combined with each other to form a 5- to 7-membered ring;

$$R_{b1}-Z_{b1} \qquad (B)$$

wherein $R_{b1}$ represents an aliphatic group and $Z_{b1}$ represents a halogen atom;

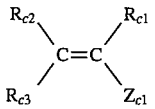

(C)

wherein $Z_{c1}$ represents a cyano group, an acyl group, a formyl group, an aliphatic oxycarbonyl group, an aromatic oxycarbonyl group, a carbamoyl group, a sulfamoyl group, or a sulfonyl group; $R_{c1}$, $R_{c2}$ and $R_{c3}$ may be the same or different and each represents a hydrogen atom, an aliphatic group, an aromatic group, a heterocyclic group, or $Z_{c1}$; and at least two of $R_{c1}$, $R_{c2}$, $R_{c3}$ and $Z_{c1}$ may be combined with each other to form a 5- to 7-membered ring;

$$R_{d1}-Z_{d1} \qquad (D)$$

wherein $R_{d1}$ represents an aliphatic group or an aromatic group; $Z_{d1}$ represents a mercapto group or —$SO_2Y$; Y represents a hydrogen atom, an atom or atomic group forming an inorganic or organic salt, —NHN=C($R_{d2}$)$R_{d3}$, —N($R_{d4}$)—N($R_{d5}$)—$SO_2$—$R_{d6}$, —N($R_{d7}$)— N($R_{d8}$)—$COR_{d9}$, or —C($R_{d10}$)($OR_{d11}$)—$COR_{d12}$, in which $R_{d2}$ and $R_{d3}$ may be the same or different and each represents a hydrogen atom, an aliphatic group, an aromatic group, or a heterocyclic group; $R_{d2}$ and $R_{d3}$ may be combined with each other to form a 5- to 7-mebered ring; $R_{d4}$, $R_{d5}$, $R_{d7}$ and $R_{d8}$ may be the same or different and each represents a hydrogen atom, an aliphatic group, an aromatic group, a heterocyclic group, an acyl group, an aliphatic oxycarbonyl group, a sulfonyl group, a ureido group, or a urethane group, provided that at least one of $R_{d4}$ and $R_{d5}$ and at least one of $R_{d7}$ and $R_{d8}$ are a hydrogen atom; $R_{d6}$ and $R_{d9}$ each represents a hydrogen atom, an aliphatic group, an aromatic group, or a heterocyclic group; $R_{d6}$ further represents an aliphatic amino grooup, an aromatic amino group, an aliphatic oxy group, an aromatic oxy group, an acyl group, an aliphatic oxycarbonyl group, or an aromatic oxycarbonyl group, in which at least two of $R_{d4}$, $R_{d5}$ and $R_{d6}$ may be combined with each other to form a 5- to 7-membered ring, and at least two of $R_{d7}$, $R_{d8}$ and $R_{d9}$ may be combined with each other to form a 5- to 7-membered ring; $R_{d12}$ represents a hydrogen atom, an aliphatic group, an aromatic group, or a heterocyclic group; $R_{d10}$ represents a hydrogen atom, an aliphatic group, an aromatic group, a halogen atom, an acyloxy group, or a sulfonyl group; and $R_{d11}$ represents a hydrogen atom or a group capable of being hydrolyzed.

Next, the compounds represented by formula (A), (B), (C) or (D) will be explained.

The groups represented by $R_{a1}$ and $R_{a2}$ are described as follows. There can be enumerated as the aliphatic group, for example, methyl, i-propyl, t-butyl, benzyl, 2-hydroxybenzyl, cyclohexyl, t-octyl, vinyl, allyl, and n-pentadecyl. The aliphatic group is preferably an alkyl group which has a carbon number of 1 to 30 and may be substituted. The aromatic group includes, for example, phenyl and naphthyl and is preferably a phenyl group which has a carbon number of 6 to 36 and may be substituted. The heterocyclic group includes, for example, thienyl, furyl, chromanyl, morpholinyl, piperazyl, and indolyl. The acyl group represented by $R_{a2}$ includes, for example, acetyl, tetradecanoyl, and benzoyl and is preferably an acyl group which has a carbon number of 2 to 37 and may be substituted. The sulfonyl group includes, for example, a methanesulfonyl group and a benzenesulfonyl group and is preferably a sulfonyl group which has a carbon number of 1 to 36 and may be substituted. The carbamoyl group includes, for example, methylcarbamoyl, diethylcarbamoyl, octylcarbamoyl, phenylcarbamoyl, and N-methyl-N-phenylcarbamoyl and is preferably a carbamoyl group which has a carbon number of 2 to 37 and may be substituted. The sulfamoyl group includes, for example, methylsulfamoyl, diethylsulfamoyl, octylsulfamoyl, phenylsulfamoyl, and N-methyl-N-phenylsulfamoyl and is preferably a sulfamoyl group which has a carbon number of 2 to 37 and may be substituted.

There can be enumerated as the heterocyclic group bonding via a nitrogen atom represented by $Z_{a2}$, for example, 1-pyrrolyl, 1-imidazolyl, 1-pyrazolyl, 2-indolyl, 1-indole, and 7-purinyl and a heterocyclic group forming an aromatic group is preferred. The aromatic group and heterocyclic group represented by $R_{a3}$, $R_{a4}$ and $R_{a5}$ and the aliphatic group represented by $R_{a5}$ have the same meanings as those defined for the aromatic group, heterocyclic group and aliphatic group represented by $R_{a1}$ and $R_{a2}$, respectively.

The aliphatic group represented by $R_{b1}$ has the same meaning as that defined for the aliphatic group represented by $R_{a1}$ and $R_{a2}$. The halogen atom represented by $Z_{b1}$ includes, for example, chlorine, bromine and iodine.

The groups represented by $Z_{c1}$ are described as follows. The acyl group, carbamoyl group, sulfamoyl group, and sulfonyl group have the same meanings as those represented by $R_{a2}$, respectively. The aliphatic oxy-carbonyl group includes, for example, methoxycarbonyl, ethoxycarbonyl, iso-propoxycarbonyl, benzyloxycarbonyl, cyclohexyloxycarbonyl, n-hexadecyloxycarbonyl, allyloxycarbonyl, and pentadecenyloxycarbonyl. The aliphatic oxycarbonyl group is preferably an alkyloxycarbonyl group which has a carbon number of 2 to 31 and may be substituted. The aromatic oxycarbonyl group includes, for example, phenyloxycarbonyl and naphthyloxycarbonyl and is preferably a phenyloxycarbonyl group which has a carbon number of 7 to 37 and may be substituted. The aliphatic group, aromatic group and heterocyclic group represented by $R_{c1}$, $R_{c2}$ and $R_{c3}$ have the same meanings as those defined for the aromatic group, heterocyclic group and aliphatic group represented by $R_{a1}$ and $R_{a2}$, respectively.

The aliphatic group and aromatic group represented by $R_{d1}$ to $R_{d10}$ and $R_{d12}$ and the heterocyclic group represented by $R_{d2}$ to $R_{d9}$ and $R_{d12}$ have the same meanings as those defined for the aromatic group, heterocyclic group and aliphatic group represented by $R_{a1}$ and $R_{a2}$, respectively. The atom or atomic group forming an inorganic or organic salt represented by Y includes, for example, Li, Na, K, Ca, Mg, triethylamine, methylamine, and ammonia. The acyl group and sulfonyl group represented by $R_{d4}$, $R_{d5}$, $R_{d7}$ and $R_{d8}$ have the same meanings as those represented by $R_{a2}$, and the oxycarbonyl group has the same meaning as that represented by $Z_{c1}$. The ureido group represented by $R_{d4}$, $R_{d5}$, $R_{d7}$ and $R_{d8}$ includes, for example, phenylureido, methylureido, N,N-dibutylureido, and N-phenyl-N-methyl-N' -methylureido and is preferably a ureido group having a carbon number of 2 to 37. The urethane group includes, for example, methylurethane and phenylurethane and is preferably a urethane group having a carbon number of 2 to 37.

The acyl group represented by $R_{d6}$ has the same meaning as that represented by $R_{a2}$, and the aliphatic oxycarbonyl group and the aromatic oxycarbonyl group have the same meanings as those represented by $Z_{c1}$.

The aliphatic amino group represented by $R_{d6}$ includes, for example, methylamino, diethylamino, octylamino, benzylamino, cyclohexylamino, dodecylamino, allylamino, and hexadecylamino, and is preferably an alkylamino group which has a carbon number of 1 to 30 and may be substituted. The aromatic amino group includes, for example, anilino, 2,4-dichloroanilino, 4-t-octylanilino, N-methylanilino, 2-methylanilino, and N-hexadecylanilino, and is preferably an anilino group which has a carbon number of 6 to 37 and may be substituted. The aliphatic oxy group includes, for example, methoxy, ethoxy, t-butyloxy, benzyloxy, and cyclohexyloxy, and is preferably an alkoxy group which has a carbon number of 1 to 30 and may be substituted. The aromatic oxy group includes, for example, phenoxy, 2,4-di-t-butylphenoxy, 2-chlorophenoxy, and 4-methoxyphenoxy, and is preferably a phenoxy group which has a carbon number of 6 to 37 and may be substituted.

The halogen atom represented by $R_{d10}$ includes, for example, chlorine, bromine and iodine. The acyloxy group includes, for example, acetyloxy and benzoyloxy, and is preferably an acyloxy group which has a carbon number of 2 to 37 and may be substituted. The sulfonyl group represented by $R_{d10}$ has the same meaning as that represented by $R_{a2}$.

The group capable of being hydrolyzed represented by $R_{d11}$ includes, for example, an acyl group, a sulfonyl group, an oxazalyl group, and a silyl group.

The compounds represented by formulas (A) to (C) are preferably compounds having a second reaction velocity constant $k_2$ (80° C.) based on p-anisidine falling within the range of 1.0 to $1\times10^{-5}$ liter/mol-sec, wherein the second reaction velocity constant $k_2$ is measured by the method described in JP-A-63-158545.

Of the compounds represented by formula (D), the compounds in which $R_{d1}$ is an aromatic group are preferred. Preferred is the compound in which when $Z_{d1}$ is $—SO_2Y$ and Y is a hydrogen atom, or an atom or atomic group forming an inorganic or organic salt, $R_{d1}$ is a phenyl group and the sum of the Hammett's σ values of the substituents present on the phenyl group to $—SO_2Y$ is 0.5 or more, wherein go is substituted with $\sigma_p$.

Of the compounds represented by formulas (A) to (D), the compounds represented by formulas (A) and (D) are preferred.

Of the compounds represented by formula (A), the compounds represented by formulas (A-I) to (A-V) are preferred:

$$R_{e1}—L_{e1}—\overset{\overset{\displaystyle O}{\|}}{C}—L_{e2}—Ar \qquad \text{(A-I)}$$

-continued

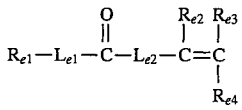

(A-II)

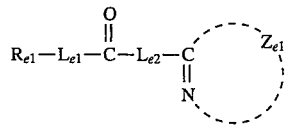

(A-III)

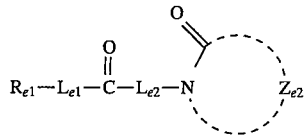

(A-IV)

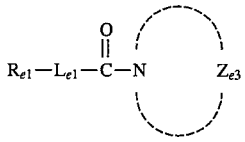

(A-V)

In formulas (A-I) to (A-V), $R_{e1}$ has the same meaning as that defined for $R_{a1}$ in formula (A). $L_{e1}$ represents a single bond or —O— and $L_{e2}$ represents —O— or —S—. Ar represents an aromatic group. $R_{e2}$ to $R_{e4}$ may be the same or different and each represents a hydrogen atom, an aliphatic group, an aromatic group, a heterocyclic group, an aliphatic oxy group, an aromatic oxy group, a heterocyclic oxy group, an aliphatic thio group, an aromatic thio group, a heterocyclic thio group, an amino group, an aliphatic amino group, an aromatic amino group, a heterocyclic amino group, an acyl group, an amide group, a sulfonamide group, a sulfonyl group, an aliphatic oxycarbonyl group, an aromatic oxycarbonyl group, a sulfo group, a carboxyl group, a formyl group, a hydroxy group, an acyloxy group, a ureido group, a urethane group, a carbamoyl group, or a sulfamoyl group. At least two of $R_{e2}$ to $R_{e4}$ may be combined with each other to form a 5- to 7-membered ring. $Z_{e1}$ and $Z_{e2}$ each represents a group of non-metal atoms necessary to form a 5- to 7-membered ring and $Z_{e3}$ represents a group of non-metal atoms necessary to form a 5- to 7-membered ring. The rings formed by $Z_{e1}$ to $Z_{e3}$ may have substituents and may form a spiro ring and a bicyclo ring. Further, they may be condensed with a benzene ring, an aliphatic ring or a heterocyclic ring.

Of the compounds represented by formulas (A-I) to (A-V), the compounds represented by formulas (A-I) and (A-III) are particularly preferred.

Representative examples of these compounds are shown below but the compounds used in the present invention will not be limited thereby.

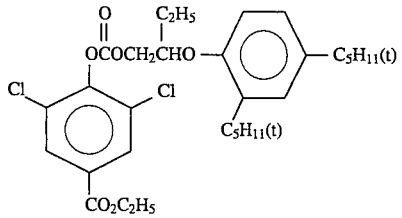

(ST-1)

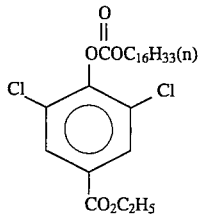

(ST-2)

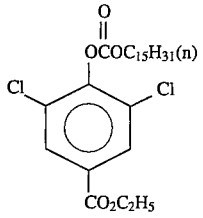

(ST-3)

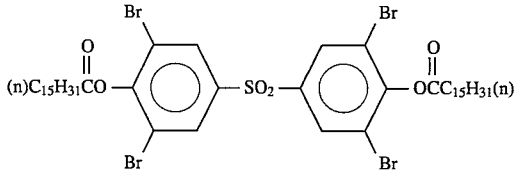

(ST-4)

-continued
(ST-5)
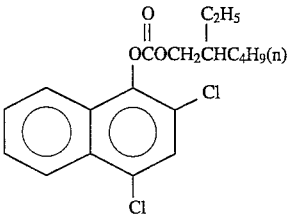
(ST-6)
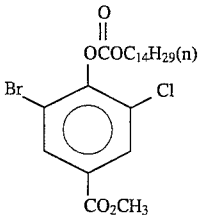
(ST-7)
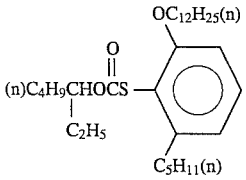
(ST-8)
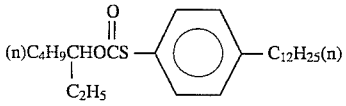
(ST-9)
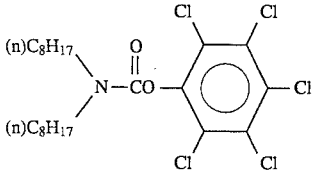
(ST-10)
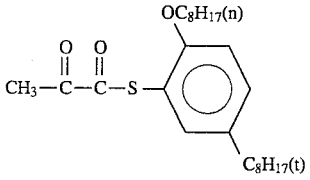
(ST-11)
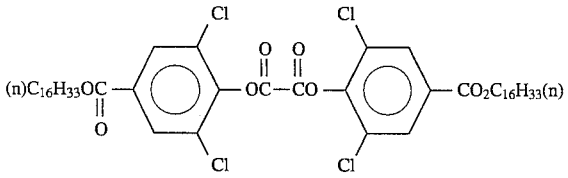
(ST-12)
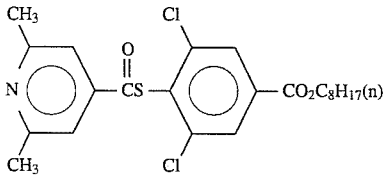
(ST-13)
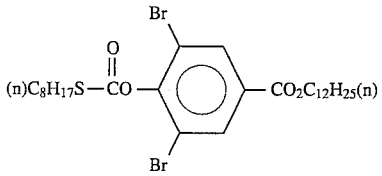

-continued
(ST-14)
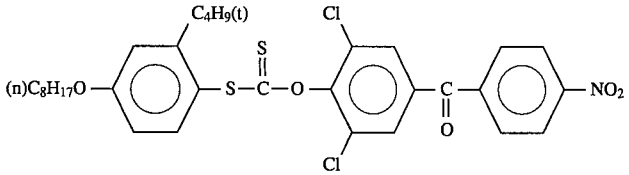
(ST-15)
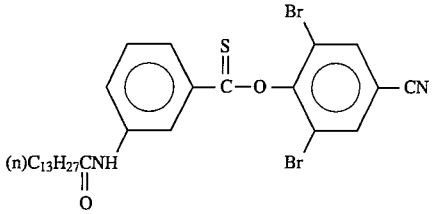
(ST-16)
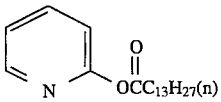
(ST-17)
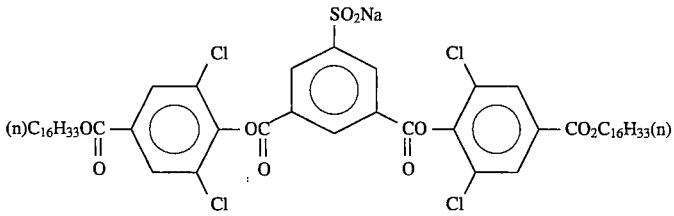
(ST-18)
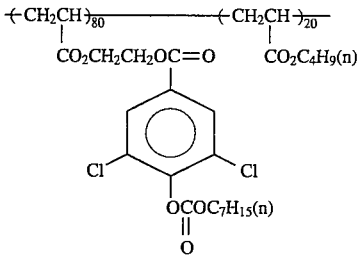
(ST-19)
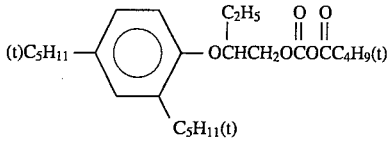
(ST-20)
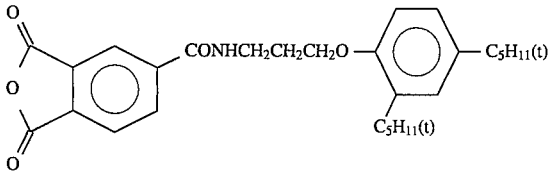
(ST-21)
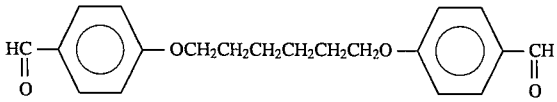
(ST-22)
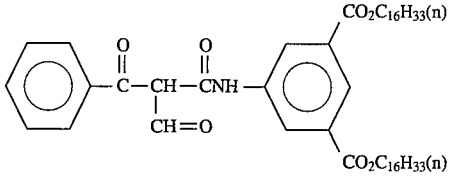

-continued
(ST-23)
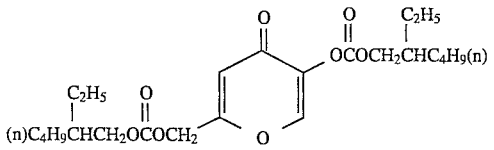
(ST-24)
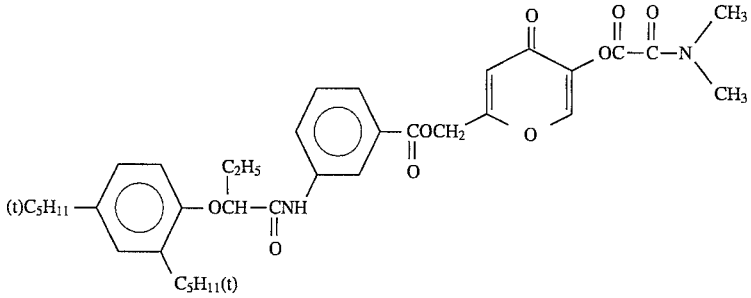
(ST-25)
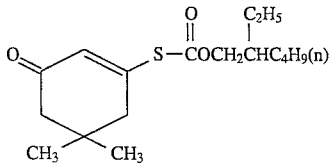
(ST-26)
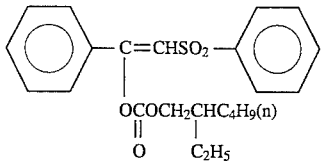
(ST-27)
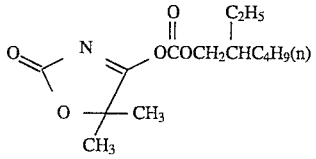
(ST-28)
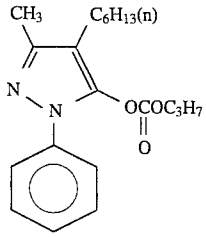
(ST-29)
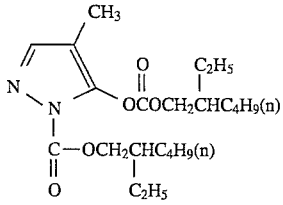
(ST-30)
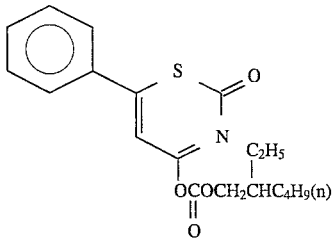

-continued
(ST-31)
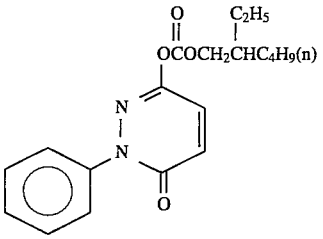
(ST-32)
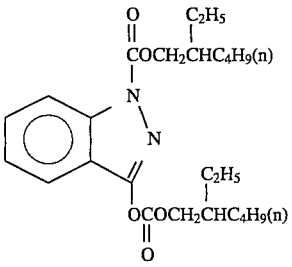
(ST-33)
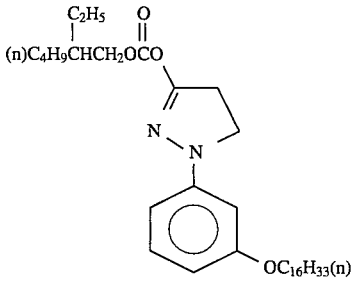
(ST-34)
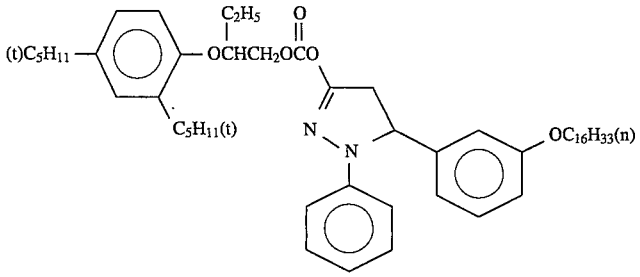
(ST-35)
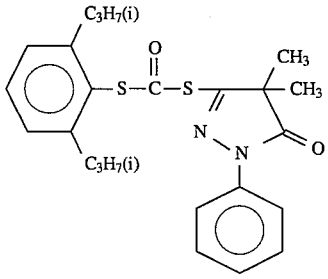
(ST-36)
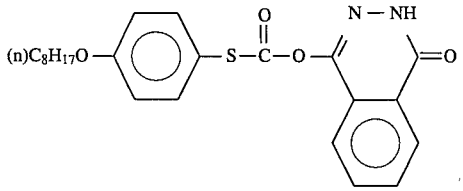

-continued
(ST-37)
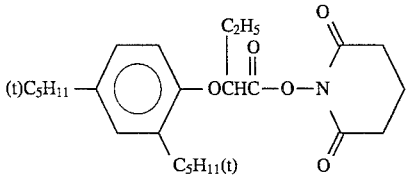
(ST-38)
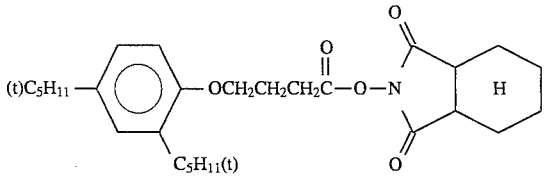
(ST-39)
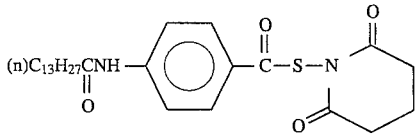
(ST-40)
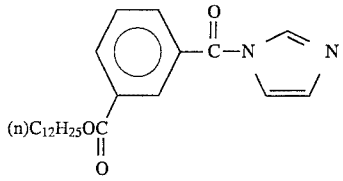
(ST-41)
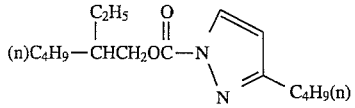
(ST-42)
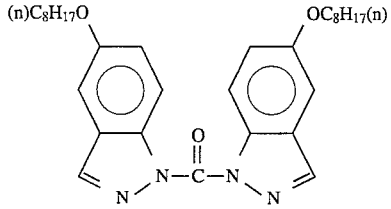
(ST-43)
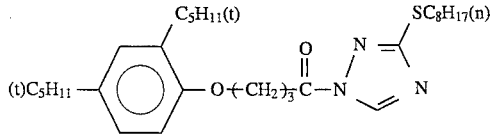
(ST-44) $(n)C_{18}H_{37}Br$
(ST-45) $(n)C_{18}H_{37}I$
(ST-46)
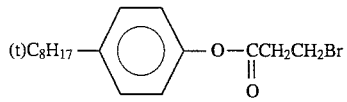
(ST-47)
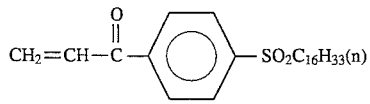
(ST-48) $CH_2{=}CH{-}SO_2{-}C_{18}H_{37}(n)$ -continued
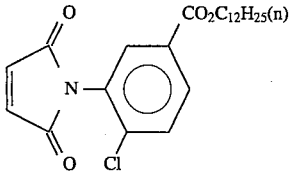
(ST-49)
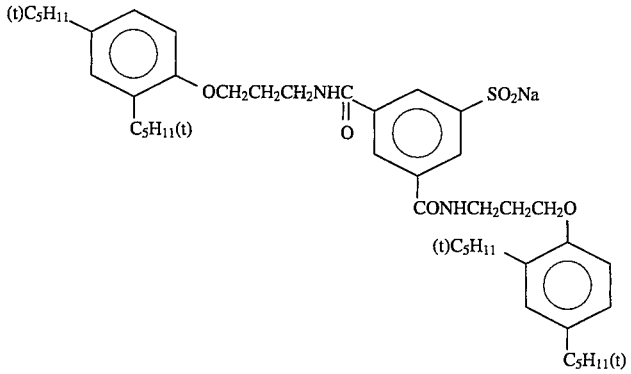
(ST-50)
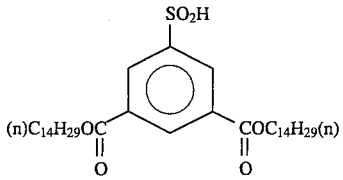
(ST-51)
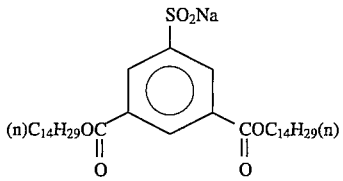
(ST-52)
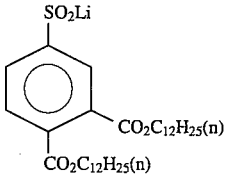
(ST-53)
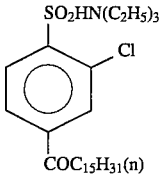
(ST-54)
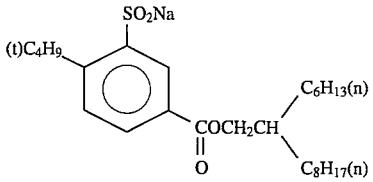
(ST-55)
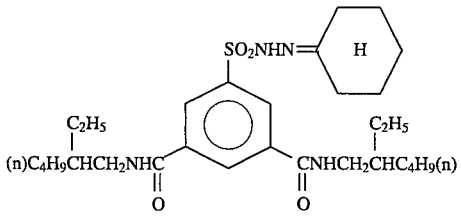
(ST-56)

-continued
(ST-57)
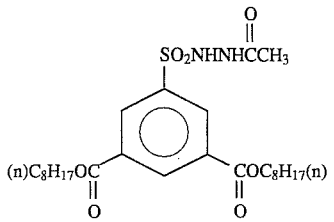
(ST-58)
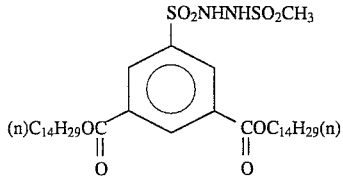
(ST-59)
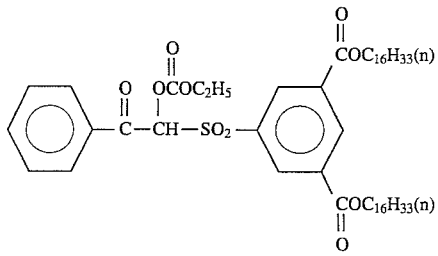
(ST-60)
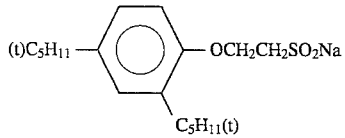
(ST-61)
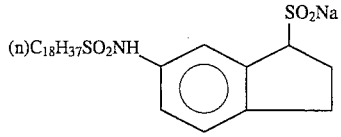
(ST-62)
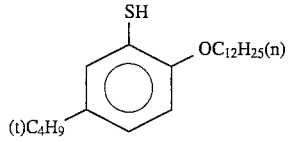
(ST-63)
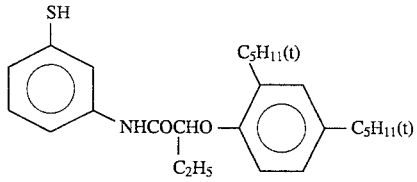
(ST-64)
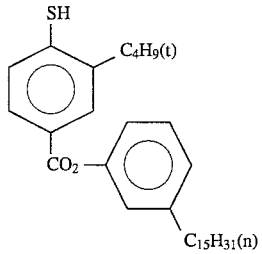
These compounds can be synthesized by the methods described in JP-A-62-143048, JP-A-63-115855, JP-A-63-115866, and JP-A-63-158545, and European Patent 255722A, and the methods according thereto.
The preferred compounds of the present invention include the compounds specifically exemplified in the above patents, JP-A-62-17665, JP-A-62-283338, JP-A-62-229145, JP-A-

64-86139, and JP-A-1-271748, and Invention Association Published Technical Report, published No. 90-9416.

The amount of the compounds of the present invention represented by formulas (A) to (D) will vary according to the kind of coupler used. The amount falls within the range of 0.5 to 300 mole %, preferably 1 to 200 mole %, and most preferably 5 to 150 mole % per mole of coupler used.

The compounds of the present invention represented by formulas (A) to (D) are used particularly preferably in an emulsion together with a coupler.

The compounds of the present invention represented by formulas (A) to (D) may be used in combination with a known anti-fading agent. In such a case, the anti-fading effect is further increased. Similarly, the compounds represented by formulas (A) to (D) may be used in combinations of two or more kinds.

There can be enumerated as representative examples of known anti-fading agents, hydroquinones, 6-hydroxychromans, 5-hydroxycoumarans, spirochromans, p-alkoxyphenols, hindered phenols represented by bisphenols, gallic acid derivatives, methylenedioxybenzenes, aminophenols, hindered amines, ultraviolet absorbers, and ether or ester derivatives thereof in which the phenolic hydroxy groups thereof are silylated and alkylated. Further, there can be used as well the metal complex compounds represented by a (bis-salicylaldoximate) nickel complex and a (bis-N,N-dialkyl-dithiocarbamate) nickel complex.

Specific examples of organic anti-fading agents include hydroquinones as described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801 and 2,816,028; 6-hydroxychromans, 5-hydroxychromans and spirochromans as described in U.S. Pat. Nos. 3,432,300, 3,573,050, 3,574,627, 3,698,909, and 3,764,337, and JP-A-52-152225; spiroindanes as described in U.S. Pat. No. 4,360,589; p-alkoxyphenols as described in U.S. Pat. No. 2,735,765, British Patent 2,066,975, JP-A-59-10539, and JP-B-57-19765 (the term "JP-B" as used herein means an examined Japanese patent publication); hindered phenols as described in U.S. Pat. Nos. 3,700,455 and 4,228,235, JP-A-52-72224, and JP-B-52-6623; gallic acid derivatives as described in U.S. Pat. No. 3,457,079; methylenedioxybenzenes as described in U.S. Pat. No. 4,332,886; aminophenols as described in JP-B-56-21144; hindered amines as described in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344; and metal complex compounds as described in U.S. Pat. Nos. 4,050,938 and 4,241,155, and British Patent 2,027,731 (A).

The couplers of the present invention and the lipophilic compounds mentioned above can be incorporated into a light-sensitive material by various conventional methods. Preferred is an oil-in-water dispersion method in which they are dissolved in a high boiling organic solvent (a low boiling organic solvent is used in combination according to necessity) and are emulsified and dispersed in a gelatin aqueous solution to be added to a silver halide emulsion.

Examples of high boiling solvents to be used in the oil-in-water dispersion method are described in U.S. Pat. No. 2,322,027. The step and effect of a latex dispersing method as one of the polymer dispersing methods and specific examples of a latex for impregnation are described in U.S. Pat. No. 4,199,363, German Patent Applications (OLS) 2,541,274 and 2,541,230, JP-B-53-41091, and European Patent 029104A, and further a dispersion method by an organic solvent-soluble polymer is described in PCT International Patent Publication WO88/00723.

There can be enumerated as the high boiling organic solvent which can be used in the above oil-in-water dispersion method, phthalic acid esters (for example, dibutyl phthalate, dioctyl phthalate, dicyclohexyl phthalate, di-2-ethylhexyl phthalate, decyl phthalate, bis(2,4-di-tert-amylphenyl)isophthalate, and bis(1,1-diethylpropyl)phthalate), phosphoric acid or phosphonic acid esters (for example, diphenyl phosphate, triphenyl phosphate, tricresyl phosphate, 2-ethylhexyldiphenyl phosphate, dioctylbutyl phosphate, tricyclohexyl phosphate, tri-2-ethylhexyl phosphate, tridodecyl phosphate, and di-2-ethylhexylphenyl phosphate), benzoic acid esters (for example, 2-ethylhexyl benzoate, 2,4-dichlorobenzoate, dodecyl benzoate, and 2-ethylhexyl-p-hydroxybenzoate), amides (for example, N,N-diethyldodecanamide and N,N-diethyllaurylamide), alcohols or phenols (for example, isostearyl alcohol and 2,4-di-tert-amylphenol), aliphatic esters (for example, dibutoxyethyl succinate, di-2-ethylhexyl succinate, 2-hexyldecyl tetradecanate, tributyl citrate, diethyl azelate, isostearyl lactate, and trioctyl citrate), an aniline derivative (for example, N,N-dibutyl-2-butoxy-5-tert-octylaniline), chlorinated paraffins (for example, paraffins having a chlorine content of 10 to 80%), trimesic acid esters (for example, tributyl trimesate), dodecylbenzene, diisopropylnaphthalene, phenols (for example, 2,4-di-tert-amylphenol, 4-dodecyloxyphenol, 4-dodecyloxycarbonylphenol, and 4-(4-dodecyloxyphenylsulfonyl)phenol), carboxylic acids (for example, 2-(2,4-di-tert-amylphenoxy)butyric acid, and 2-ethoxyoctane-decanoic acid), and alkylphosphoric acids (for example, di-2(ethylhexyl)phosphoric acid and diphenylphosphoric acid). Further, there may be used in combination as an auxiliary solvent, an organic solvent having a boiling point of 30° C. or higher and about 160° C. or lower (for example, ethyl acetate, butyl acetate, ethyl propionate, methyl ethyl ketone, cyclohexanone, 2-ethoxyethyl acetate, and dimethylformamide).

The high boiling organic solvents can be used in the amount of 0 to 2.0 times, preferably 0 to 1.0 times based on the amount of the coupler in terms of a weight ratio.

The silver halide color photographic light-sensitive material of the present invention is required to have a film pH of 4.0 to 6.5, more preferably 5.0 to 6.0, wherein the film pH is the pH in the whole photographic layers obtained by applying the coating solutions on a support. The film pH is not necessarily, the same as the pH of the coating solutions.

The film pH can be measured by the following method described in JP-A-61-245153. That is, (1) pure water 0.05 ml is dropped on the surface of a light-sensitive layer side on which a silver halide emulsion is coated; and (2) after standing for 3 minutes, the film pH is measured with a film pH measuring electrode (GS-165F manufactured by Toa Denpa Co., Ltd.).

The film pH can be controlled by adding acid (for example, sulfuric acid and citric acid) or alkali (for example, sodium hydroxide and potassium hydroxide) to a coating solution according to necessity. The film pH of a light sensitive material lower than 4.0 is liable to cause trouble such as preventing the hardening of the light-sensitive material.

At least one yellow color developing silver halide emulsion layer, at least one magenta color developing silver halide emulsion layer and at least one cyan color developing silver halide emulsion layer can be provided on a support having a reflection layer to thereby constitute the color light-sensitive material of the present invention. In a general color photographic paper, the color coupler which forms a dye having the relationship of a complementary color with rays to which a silver halide emulsion is sensitive can be incorporated to carry out a color reproduction by a subtractive color process. In conventional color photographic paper, the silver halide emulsion grains are spectrally sensitized with blue-sensitive, green-sensitive and red-sensitive spectral sensitizing dyes, respectively, in order of the above color developing layers, and the respective emulsions can be coated on the support in the above order to constitute the color photographic paper. However, the order may be different from this. That is, the light-sensitive emulsion layer containing the silver halide grains with the largest average grain size is preferably provided uppermost in some cases from the viewpoint of rapid processing, and the lowest layer is preferably a magenta color developing light-sensitive emulsion layer in some cases from the viewpoint of storage property under the irradiation of light.

There may be used a constitution in which the light-sensitive layers and the hues of developed colors do not have the above-described relationship, and at least one infrared-sensitive silver halide emulsion layer can be used as well.

In the present invention, silver chloride, silver chlorobromide or silver chloroiodobromide grains each having a silver chloride content of 95 mole % or more are preferably used as the silver halide grains. In particular, in the present invention, silver halide comprising silver chlorobromide or silver chloride containing substantially no silver iodide can be preferably used in order to accelerate the development processing time, wherein the term "containing substantially no silver iodide" means that the silver iodide content is 1 mol % or less, preferably 0.2 mol % or less. Meanwhile, high silver chloride grains containing silver iodide of 0.01 to 3 mol % on an emulsion surface as described in JP-A-3-84545 are preferably used in some cases for the purposes of increasing the sensitivity at high illuminance, raising the spectral sensitization sensitivity and improving the aging stability of a light-sensitive material. The silver halide grains in the emulsion may all have the same halogen composition or they may have different compositions. The use of an emulsion containing grains each having the same composition can readily homogenize the quality of each of the grains. With respect to the halogen composition distribution in the inside of the silver halide emulsion grains, there can suitably be selected and used the grains of a so-called homogeneous type structure in which the composition is the same at any part of the silver halide grain, the grains of a so-called laminating type structure in which a core present in the inside of the silver halide grain and the shell (one layer or plural layers) surrounding it have different halogen compositions, or the grains of the structure in which there are present the portions having different halogen compositions in the inside or on the surface of the grain in the form of a non-layer (a structure in which the portions of different compositions are conjugated at the edge, corner or surface of the grain in the case where they are present on the surface of the grain). The use of either of the latter two rather than the grains of the homogeneous type structure is advantageous for obtaining a high sensitivity and is preferred as well from the viewpoint of pressure resistance performance. In the case where the silver halide grains have the above structures (i.e., the non-homogeneous structures), the boundary at the portions having different halogen compositions may have a distinct boundary or an indistinct boundary in which a mixed crystal is formed according to the composition difference, or a structure in which a continuous structural change is allowed to positively be provided.

In the high silver chloride emulsion used in the present invention, preferred is an emulsion having a structure in which a silver bromide-localized phase is present in the form of a layer or non-layer as mentioned above in the inside of a silver halide grain and/or on the surface thereof. The halogen composition in the above localized phase is preferably at least 10 mole %, more preferably exceeding 20 mole % in terms of the silver bromide content.

The silver bromide content in the silver bromide-localized phase can be analyzed with an X ray diffraction process (described in, for example, "*New Experimental Chemistry Course 6, Structural Analysis*" edited by Japan Chemistry Association, Maruzen). These localizing phases can be present in a grain inside or at the edge, corner or on the plane of a grain surface. A localized phase epitaxially grown at the corner portion of the grain can be enumerated as one preferred example.

It is effective as well to further increase the silver chloride content in a silver halide emulsion for the purpose of reducing the replenishing amount of the development processing solution. In such a case, an emulsion of almost pure silver chloride having a silver chloride content of 98 to 100 mol % can be preferably used as well.

The sliver halide grains contained in the silver halide emulsion used in the present invention preferably have an average grain size (the grain size is defined by the diameter of the circle having the same area as that of the projected area of the grain and a number average is calculated therefrom) of 0.1 to 2 μm.

In the size distribution of these grains, preferred is a so-called monodispersion in which the variation coefficient (obtained by dividing the standard deviation in the grain size distribution by the average grain size) is 20% or less, preferably 15% or less, and more preferably 10% or less. The above monodispersed emulsions are preferably used for the same layer in a blend or simultaneously coated for the purpose of obtaining a broad latitude.

There can be used as the silver halide grains contained in a photographic emulsion, the grains having a regular crystal form such as cube, octahedron and tetradecahedron, the grains having an irregular crystal form such as sphere and plate, or composite forms thereof. Further, the emulsion may consist of a mixture of grains having various crystal forms. In the present invention, of these emulsions, an emulsion in which 50% or more, preferably 70% or more, and more preferably 90% or more, of the grains have a regular crystal form.

In addition thereto, preferably used as well is an emulsion in which tabular grains having an average aspect ratio (circle area-corresponding diameter/thickness) of 5 or more, preferably 8 or more, exceed 50% of all the grains in terms of projected area.

The emulsion used in the present invention can be synthesized by the methods described in "*Chemie et Phisique Photographique*" written by P. Glafkides (published by Paul Montel Co., Ltd., 1967), "*Photographic Emulsion Chemistry*" written by G. F. Duffin (published by Focal Press Co., Ltd., 1966), and "*Making and Coating Photographic Emulsion*" written by V. L. Zelikman et al., (published by Focal Press Co., Ltd., 1964). That is, there may be used any of an acid method, a neutral method and an ammonia method. Any of a single jet method, a double jet method and combinations thereof may be used as the method for reacting a water soluble silver salt with a water soluble halide. There can be used as well the method in which the grains are formed under the presence of excessive silver ions (a so-called reverse mixing method). There can be used as one form of the double jet method, the method in which the pAg of the solution in which the sliver halide grains are formed is maintained constant, that is, a so-called controlled double jet method. There can be obtained with this method, a silver halide emulsion having a regular crystal form and an almost uniform grain size.

Metal ion which is different from a silver ion or a complex ion thereof is preferably incorporated into the localized phase or substrate of the silver halide grains according to the present invention. The preferred metal is selected from metal ions or metal complexes belonging to Group VIII and Group IIb, lead ion, and thallium ion. There can be used mainly for the localized phase, ions or complex ions thereof selected from iridium, rhodium and iron, and there can be used mainly for the substrate, metal ions or complex ions thereof selected from osmium, iridium, rhodium, platinum, ruthenium, palladium, cobalt, nickel, and iron alone or in combination thereof. The kinds and concentrations of metal ions may be different between the localized phase and the substrate. Plural kinds of these metals may be used. In particular, the iron and iridium compounds are allowed to be present preferably in the silver bromide-localized phase.

These metal ion-providing compounds are incorporated into the localized phase and/or other grain portions (substrate) by means of adding the compounds to a gelatin aqueous solution which is a dispersant, a halide aqueous solution, a silver salt aqueous solution or other aqueous solutions in the formation of the sliver halide grains, or adding in the form of silver halide fine grains into which the metal ion is incorporated in advance and dissolving these fine grains.

The metal ions used in the present invention can be incorporated into the emulsion grains before grain formation, during the grain formation or immediately after the grain formation. This can be changed according to what position of the grain the metal ion is incorporated into.

The silver halide emulsion used in the present invention is usually subjected to a chemical sensitization and a spectral sensitization.

There can be used singly or in combination as the chemical sensitization, a chemical sensitization in which a chalcogen sensitizer is used (to be specific, there can be enumerated a sulfur sensitization represented by the addition of an unstable sulfur compound, a selenium sensitization with a selenium compound, and a tellurium sensitization with a tellurium compound), a noble metal sensitization represented by a gold sensitization, and a reduction sensitization. Those described in a right lower column at page 18 to a right upper column at page 22 of JP-A-62-215272 are preferably used as the compound for the chemical sensitization.

The effect given by the constitution of the light-sensitive material according to the present invention is more notable than that given by a light-sensitive material in which a high silver chloride emulsion subjected to a gold sensitization is used.

The emulsion used in the present invention is a so-called surface latent image type emulsion in which a latent image is formed primarily on the grain surfaces.

Various compounds or precursors thereof can be added to the silver halide emulsion used in the present invention for the purposes of preventing fog or stabilizing the photographic performances in a production process and during storing or photographic processing. The compounds described at pages 39 to 72 of the above mentioned JP-A-62-215272 are specific examples of these compounds. Further, preferably used as well is the 5-arylamino-1,2,3,4-thiatriazole compound (the aryl residue has at least one electron attractive group) described in European Patent EP 0,447,647.

A spectral sensitization is carried out for the purpose of providing the emulsions contained in the respective layers of the light-sensitive material of the present invention with the spectral sensitivities in the prescribed wavelength regions.

In the light-sensitive material of the present invention, there can be enumerated as the spectral sensitizing dye used for the spectral sensitization in the blue, green and red regions, the compounds described in, for example, "*Heterocyclic Compounds—Cyanine Dyes and Related Compounds*" written by F. M. Harmer (published by John Wiley & Sons, New York, London, 1964). Those described in the right upper column at pages 22 to 38 of the above JP-A-62-215272 are preferably used as specific examples of the compounds and the spectral sensitizing method. In particular, the spectral sensitizing dyes described in JP-A-3-123340 are very much preferred as the red-sensitive spectral sensitizing dye for the silver halide emulsion grains having a high silver chloride content from the viewpoint of stability, the strength of the adsorption and the temperature dependency in an exposure.

In the case where spectral sensitization in an infrared region is efficiently carried out in the light-sensitive material of the present invention, preferably used are the sensitizing dyes described in the left upper colunm at page 12 to the left lower column at page 21 of JP-A-3- 15049, in the left lower column at page 4 to the left lower column at page 15 of JP-A-3-20730, on the 21st line at page 4 to the 54th line at page 6 of European Patent EP 0,420,011, on the 12th line at page 4 to the 33rd line at page 10 of European Patent EP 0,420,012, and in European Patent EP 0,443,466 and U.S. Pat. No. 4,975,362.

In order to incorporate these spectral sensitizing dyes into a silver halide emulsion, they may be dispersed directly in an emulsion, or may be dissolved in a single solvent or mixed solvent such as water, methanol, ethanol, propanol, methyl cellosolve, or 2,2,3,3-tetrafluoropropanol to be added to the emulsion. Also, as described in JP-B-44- 23389, JP-B-44-27555 and JP-B-57-22089, they may be dissolved in water in the presence of an acid or a base, and as described in U.S. Pat. Nos. 3,822,135 and 4,006,025, an aqueous solution or colloid dispersion which is prepared in the presence of a surface active agent may be added to the emulsion. Further, after dissolving in a solvent which is substantially immiscible with water, such as phenoxyethanol, the solution may be dispersed in water or a hydrophilic colloid to add it to the emulsion. As described in JP-A-53-102733 and JP-A-58-105141, the dispersion, which is prepared by dispersing the dyes directly in a hydrophilic colloid, may be added to the emulsion.

The timing of adding the sensitizing dyes to the emulsion may be at any step in preparing the emulsion, which has so far been known as effective. That is, it can be selected from any of before the grain formation of the silver halide emulsion, during the grain formation, from immediately after the grain formation to before proceeding to a washing step, before a chemical sensitization, during the chemical sensitization, from immediately after the chemical sensitization to the solidification of the emulsion by cooling, and in the preparation of a coating solution. Most usually, it is carried out at the period of from after the completion of the chemical sensitization to before coating. However, as described in U.S. Pat. Nos. 3,628,969 and 4,225,666, the dyes can be added at the same period as the chemical sensitization to carry out the spectral sensitization simultaneously with the chemical sensitization. Also, as described in JP-A-58-113928, the spectral sensitization can be carried out prior to the chemical sensitization. The sensitizing dyes can be added before completing the precipitation of the silver halide grains to start the spectral sensitization. Further, as taught in U.S. Pat. No. 4,225,666, a divided sensitizing dye can be added as well, that is, a part thereof is added prior to the chemical sensitization and the rest is added after the chemical sensitization. The addition of the spectral sensitizing dyes may be at any period during the formation of the silver halide grains as well as the method taught in U.S. Pat. No. 4,183,756. Among them, particularly preferred is the addition of the sensitizing dyes before a washing step for the emulsion or before the chemical sensitization.

The addition amount of these spectral sensitizing dyes is extended over a wide range according to the situation. It falls preferably within the range of $0.5\times 10^{-6}$ to $1.0\times10^{-2}$ mole, more preferably $1.0\times10^{-6}$ to $5.0\times 10^{-3}$ mole per mole of silver halide.

In the present invention, in the case where a sensitizing dye having a spectral sensitization sensitivity particularly in a red region to an infrared region is used, it is preferably used in combination with the compounds described in the right lower column at page 13 to the right lower column at page 22 of JP-A-2-157749. The use of these compounds can specifically increase the storing performance, stability in processing and the supersensitization effect of the light-sensitive material. Above all, the compounds of formulas (IV), (V) and (VI) in the above patent are particularly preferably used in combination with the sensitizing dye. These compounds are used in the amount of $0.5\times10^{-5}$ to $5.0\times10^{-2}$ mole, preferably $5.0\times10^{-5}$ to $5.0\times 10^{-3}$ mole per mole of silver halide, and the advantageous use amount thereof falls within the range of 0.1 to 10000 times, preferably 0.5 to 5000 times the amount of the sensitizing dye, on a molar basis.

The light-sensitive material according to the present invention is used not only for a print system in which a conventional negative printer is used but also preferably for a digital scanning exposure in which there is used a single color high density light such as a gas laser, a light emitting diode, a semiconductor laser, or a second higher harmonics-generating light source (SHG) consisting of a combination of a semiconductor laser or a solid state laser in which the semiconductor laser is used for an exitation light source with a non-linear optical crystal. In order to make the system compact and inexpensive, a semiconductor laser or a second higher harmonics-generating light source (SHG) consisting of a combination of a semiconductor laser or a solid state laser with a non-linear optical crystal is preferably used. In particular, in order to design compact and inexpensive equipment having a long life and a high stability, the semiconductor laser is preferably used and the semiconductor laser is preferably used for at least one of the exposing light sources.

In the case where such a scanning exposing light source is used, the spectral sensitivity maximum of the light-sensitive material according to the present invention can arbitrarily be set up according to the wavelength of the scanning exposing light source used. In the SHG light source obtained by combining a solid state laser in which a semiconductor laser is used for an exitation light source or a semiconductor laser with a non-linear optical crystal, a blue light and a green light can be obtained since the oscillation wavelength of the laser can be cut to a half. Accordingly, it is possible to allow the spectral sensitivity maximums of the light-sensitive material to fall within the three conventional ranges of blue, green and red. In order to use the semiconductor laser as the light source for making the equipment inexpensive, highly stable and compact, at least two layers preferably have spectral sensitivity maximums in the range of 670 nm or more. This is because the light emitting wavelength of the commercially available, inexpensive and stable III–V Group series semiconductor lasers ranges only in the red to infrared region. However, the emitting of a II–VI Group series semiconductor laser in the green and blue regions is confirmed at a laboratory level and it can be expected that progress in the manufacturing technique of semiconductor lasers will enable serious to inexpensively and stably use these semiconductor lasers. In such a case, it is less necessary that at least two layers have spectral sensitivity maximums of 670 nm or more.

In such a scanning exposure, the time when silver halide contained in a light-sensitive material is exposed is the time necessary to expose some minute area. The minimum unit for controlling a quantity of light in the respective digital data is generally used as this minute area and is called a picture element or pixel. Accordingly, the exposing time per picture element is varied according to the size of the picture element. The size of the picture element depends on the picture element density and the practical range thereof is 50 to 2000 dpi. The exposing time is preferably $10^{-4}$ second or less, further preferably $10^{-6}$ second or less, wherein the exposing time is defined by the time for exposing a picture element size on the assumption that the picture element density is 400 dpi.

For the purpose of preventing irradiation and halation and improving safelight safety, preferably added to a hydrophilic colloid layer are dyes (above all, an oxonol dye and an cyanine dye) capable of being decolored by processing, described at pages 27 to 76 of European Patent EP 0,337, 490A2.

The dyes in which the increase in the use amounts thereof deteriorates color separation and safelight safety are included in these water soluble dyes. The water soluble dyes described in EP 0539978A1, JP-A-5-127325, and JP-A-5-127324 are preferred as dyes capable of being used without deteriorating the color separation.

In the present invention, a coloring layer capable of being decolored by processing may be used in place of or in combination with the water soluble dyes. A coloring layer capable of being decolored by the processing used either may contact directly an emulsion layer or may be provided so that it contacts the emulsion layer via an intermediate layer containing gelatin and an anti-color mixing agent such as hydroquinone. This coloring layer is provided preferably below (a support side) the emulsion layer coloring to the same kind of an elementary color as that of the colored color thereof. It is possible either to independently provide all of the coloring layers corresponding to the respective elementary colors or to arbitrarily select only a part thereof to provide it. Further, it is possible as well to provide a coloring layer colored so that it corresponds to a plurality of the elementary color regions. In the optical reflection density in the coloring layer, the optical density value at the wavelength at which the optical density is the highest in the wavelength region used for an exposure (the visible ray region of 400 to 700 nm in case of a usual printer exposure and the wavelength of a scanning exposure light source in case of a scanning exposure) is 0.2 or more and 3.0 or less, more preferably 0.5 or more and 2.5 or less, and particularly preferably 0.8 or more and 2.0 or less.

Known methods can be applied to form the coloring layer. They include, for example, the method in which the dyes are incorporated into a hydrophilic colloid layer in the form of a solid fine particle dispersion as is the case with the dyes described in the right upper column at page 3 to page 8 of JP-A-2-282244 and the dyes described in the right upper column at page 3 to the left lower column at page 11 of JP-A-3-7931, the method in which an anionic dye is mordanted to a cationic polymer, the method in which a dye is adsorbed on a fine particle of silver halide to fix it in a layer, and the method in which colloidal silver is used as described in JP-A-1-239544. There is described at pages 4 to 13 of JP-A- 2-308244 as the method in which the fine powder of the dye is dispersed in the form of a solid matter, for example, the method in which there is incorporated a fine powder dye which is substantially insoluble in water at pH 6 or lower but substantially soluble in water at pH 8 or higher. Further, the method in which an anionic dye is mordanted to a cationic polymer is described at pages 18 to 26 of JP-A-2-84637. The method for preparing colloidal silver as a photo-absorbing agent is shown in U.S. Pat. Nos. 2,688,601 and 3,459,563. Of these methods, preferred are the method in which the fine powder dye is incorporated and the method in which colloidal silver is used.

Gelatin is advantageously used as the binder or protective colloid which can be used for the light-sensitive material according to the present invention, and other hydrophilic colloids can be used as well singly or together with gelatin. Low calcium gelatin having a calcium content of 800 ppm or less, more preferably 200 ppm or less is preferably used. Further, the anti-mold agents described in JP-A-63-271247 are preferably added in order to prevent various molds and fungi which grow in a hydrophilic colloid layer to deteriorate the image.

In subjecting the light-sensitive material according to the present invention to a printer exposure, the band stop filter described in U.S. Pat. No. 4,880,726 is preferably used, whereby a light mixture is removed to notably improve color reproduction.

An exposed light-sensitive material can be subjected to a conventional color development processing. In the case of a color light-sensitive material of the present invention, it is preferably subjected to a bleach-fixing processing after the color development for the purpose of rapid processing. In particular, in the case where the above high silver chloride emulsion is used, the pH of the bleach-fixing solution is preferably about 6.5 or less, more preferably about 6 or less for the purpose of accelerating desilvering.

Those described in the following patent publications, particularly European Patent EP 0,355,660A2 (JP-A-2-139544) are preferably used as the silver halide emulsions, other materials (the additives) and photographic constitutional layers (a layer arrangement) each applied to the light-sensitive material according to the present invention, and the processing methods which are applied for processing this light-sensitive material, and the additives for processing:

| Photographic elements | JP-A-62-215272 | JP-A-1-33144 | EP 0,355,660A2 |
|---|---|---|---|
| Silver halide emulsion | p. 10, right upper colmn, line 6 to p. 12, left lower colmn, line 5, and p. 12, right lower column, line 4 from bottom to p. 13, left upper colmn, line 17. | p. 28, right upper colmn, line 16 to p. 29, right lower column, line 11, and p. 30, lines 2 to 5. | p. 45, line 53 to p. 47, line 3, and p. 47, lines 20 to 22. |
| Silver halide solvent | p. 12, left lower colmn, lines 6 to 14, and p. 13, left upper colmn, line 3 from bottom to p. 18, left lower colmn, last line. | — | — |
| Chemical sensitizer | p. 12, left lower colmn, line 3 from bottom to right lower colmn, line 5 from bottom, and p. 18, right lower colmn, line 1 to p. 22, right upper colmn, line 9 from bottom. | p. 29, right lower colmn, line 12 to last line. | p. 47, lines 4 to 9. |
| Spectral sensitizer (spectral sensitizing method) | p. 22, right upper colmn, line 8 from bottom to p. 38, last line. | p. 30, left upper colmn, lines 1 to 13. | p. 47, line 10 to 15. |
| Emulsion stabilizer | p. 39, left upper colmn, line 1 to pp. 72, right upper colmn, last line. | p. 30, left upper colmn, line 14 to right upper colmn, line 1. | p. 47, line 16 to 19. |
| Development accelerator | p. 72, left lower colmn, line 1 to p. 91, right upper colmn, line 3. | — | — |
| Color coupler (cyan, magenta and yellow couplers) | p. 91, right upper colmn, line 4 to p. 121, left upper colmn, line 6. | p. 3, right upper colmn, line 14 to p. 18, left upper colmn, last line, and p. 30, right upper colmn, line 6 to p. 35 right lower colmn, line 11. | p. 4, lines 15 to 27, p. 5, line 30 to p. 28, last line, and p. 47, line 23 to p. 63, line. 50 |
| Color forming accelerator | p. 121, left upper colmn, line 7 to p. 125, right upper colmn, line 1. | — | — |
| UV absorber | p. 125, right upper colmn, line 2 to p. 127, left lower colmn, last line. | p. 37, right lower colmn, line 14 to p. 38, left upper colmn, line 11. | p. 65, line 22 to 31. |
| Anti-fading agent (an image stabilizer) | p. 127, right lower colmn, line 1 to p. 137, left lower colmn, line 8. | p. 36, right upper colmn, line 12 to p. 37, left upper colmn, line 19. | p. 4, line 30 to p. 5, line 23, p. 29, line 1 to p. 45, line 25, p. 45, line 33 to 40, and p. 65, lines 2 to 21. |
| High boiling and/or low | p. 137, left lower colmn, line 9 to p. 144, right | p. 35, right lower colmn, line 14 to p. 36, left | p. 64, line 1 to 51. |

-continued

| Photographic elements | JP-A-62-215272 | JP-A-1-33144 | EP 0,355,660A2 |
|---|---|---|---|
| boiling organic solvent | upper, last line. | upper column, line 4. | |
| Method for dispersing photographic additives | p. 144, left lower colmn, line 1 to p. 146, right upper colmn, line 7. | p. 27, right lower colmn, line 10 to p. 28, left upper column, last line, and p. 35, right lower colmn, line 12 to p. 36, right upper colmn, line 7. | p. 63, line 51 to p. 64, line 56. |
| Hardener | p. 146, right upper colmn, line 8 to p. 155, left lower colmn, line 4. | — | — |
| Precursor of a developing agent | p. 155, left lower colmn, line 5 to right lower colmn, line 2. | — | — |
| Development inhibitor-releasing compound | p. 155, right lower colmn, lines 3 to 9. | — | — |
| Light-sensitive material layer structure | p. 156, left upper colmn, line 15 to p. 156, right lower colmn, line 14. | p. 28, right upper colmn, lines 1 to 15. | p. 45, lines 41 to 52. |
| Dye | p. 156, right lower colmn, line 15 to p. 184, right lower colmn, last line. | p. 38, left upper colmn, line 12 to right upper colmn, line 7. | p. 66, lines 18 to 22. |
| Anti-color mixing agent | p. 185, left upper colmn, line 1 to p. 188, right lower colmn, line 3. | p. 36, right upper colmn, lines 8 to 11. | p. 64, line 57 to p. 65, line 1. |
| Gradation controller | p. 188, right lower colmn, lines 4 to 8. | — | — |
| Anti-stain agent | p. 188, right lower colmn, line 9 to p. 193, right lower colmn, line 10. | p. 37, left upper colmn, last line to right lower colmn, line 13. | p. 65, line 32 to p. 66, line 17. |
| Surface active agent | p. 201, left lower colmn, line 1 to p. 210, right upper colmn, last line | p. 18, right upper colmn, line 1 to p. 24, right lower colmn, last line, and p. 27, left lower colmn, line 10 from bottom to right lower colmn, line 9 | — |
| Fluorinated compound (anti-electrification agent, coating aid, lubricant and anti-adhesion agent) | p. 210, left lower colmn, line 1 to p. 222, left lower colmn, line 5. | p. 25, left upper colmn, line 1 to p. 27, right lower colmn, line 9. | — |
| Binder (hydrophilic colloid) | p. 222, left lower colmn, line 6 to p. 225, left upper colmn, last line. | p. 38, right upper colmn, lines 8 to 18. | p. 66, line 23 to 28. |
| Thickener | p. 225, right upper colmn, line 1 to p. 227, right upper colmn, line 2. | — | — |
| Anti-electrification agent | p. 227, right upper colmn, line 3 to p. 230, left upper colmn, line 1. | — | — |
| Polymer latex | p. 230, left upper colmn, line 2 to p. 239, last line | — | — |
| Matting agent | p. 240, left upper colmn, line 1 to right upper colmn, last line. | — | — |
| Photographic processing method (processing steps and additives) | p. 3, right upper colmn, line 7 to p. 10, right upper colmn, line 5. | p. 39, left upper colmn, line 4 to p. 42, left upper colmn, last line. | p. 67, line 14 to p. 69, line 28. |

Remarks:

1. There is included in the cited items of JP-A-62-215272, the content amended according to the Amendment of March 16, 1987, which was inserted at the end of this publication.

2. Of the above couplers, preferably used as the yellow coupler are the so-called short wave type yellow couplers described in JP-A-63-231451, JP-A-63-123047, JP-A-63-241547, JP-A-1-173499, JP-A-1-213648, and JP-A-1-250944.

In addition to the compounds described in the above tables, preferably used as the yellow coupler are the acylacetoamide type yellow couplers having an acyl group with a 3- to 5-membered cyclic structure, described in European Patent EP 0,447,969A1, the malondianilide type yellow couplers having a cyclic structure, described in European Patent EP 0,482,552A1, and the acylacetoamide type yellow couplers having a dioxane structure, described in U.S. Pat. No. 5,118,599. Of them, particularly preferably used are the acylacetoamide type yellow coupler in which the acyl group is a 1-alkylcyclopropane-1-carbonyl group, and the malondianilide type yellow coupler in which one of the anilides constitutes an indoline ring. These couplers can be used singly or in combination.

There can be used as the magenta coupler used in the present invention, the 5-pyrazolone series magenta couplers and pyrazoloazole series magenta couplers described in the publicly known literatures shown in the above tables. Of them, preferably used in terms of the stability of the hue and the image and the color development performance are the pyrazolotriazole couplers in which a secondary or tertiary alkyl group is connected directly to the 2-, 3- or 6-position of the pyrazolotriazole ring, as described in JP-A-61-65245, the pyrazoloazole couplers containing a sulfonamide group in the molecule, as described in JP-A-61-65246, the pyrazoloazole couplers having an alkoxy-phenylsulfonamide ballast group, as described in JP-A-61-147254, and the pyrazoloazole couplers having an alkoxy group or aryloxy group at the 6-position, as described in European Patents 226,849A and 294,785A.

In addition to the methods described in the above tables, preferred as the processing method for the color light-sensitive material of the present invention are the processing materials and processing methods described on the 1st line of the right lower column at page 26 to the 9th line of the right upper column at page 34 of JP-A-2-207250, and on the 17th line of the left upper column at page 5 to the 20th line of the right lower column at page 18 of JP-A-4-97355.

EXAMPLES

Examples of the present invention will be shown below but the scope of the present invention should not be limited thereto.

EXAMPLE 1

Preparation of a base paper:

A mixture of wooden pulps (LBKP/NBSP=2/1) was beaten to prepare a pulp slurry having a Canadian freeness of 250 ml. Next, this pulp slurry was diluted with water and then there were added thereto anionic polyacrylamide 1.0% (Polystron 195 having a molecular weight of about 1.10 million, manufactured by Arakawa Rinsan Co., Ltd.), aluminium sulfate 1.0%, and poly-amidepolyamineepichlorohydrin 0.15% (Kaimen 557 manufactured by DIC Hercules Co., Ltd.) based on the amount of the pulp. Further, after adding 0.4 weight % of each of epoxidized behenic amide and an alkylketene dimer (a compound in which the alkyl group is $C_{20}H_{41}$) based on the weight of the pulp, 0.5% of each of sodium hydroxide and cationic polyacrylamide and 0.1% of a defoaming agent were added so that the pH was adjusted to 7. The pulp slurry thus prepared was subjected to a paper making to 180 g/m$^2$.

The base paper thus prepared was adjusted to a water content of about 2% in an oven and then was subjected to a size press with an aqueous solution having the following composition as a surface sizing solution to thereby coat the solution so that the coated amount thereof became 20 g/m$^2$ on the surface (the photographic emulsion-coated side) of the base paper.

| Compositions of Aqueous Solution | Weight Percent |
|---|---|
| Polyvinly alcohol | 4.0% |
| Calcium chloride | 4.0% |
| Fluorescent whitening agent | 0.5% |
| Defoaming agent | 0.005% |
| Water | balance |

The thickness of the sizing solution-coated paper thus obtained was adjusted to 180 μm with a machine calender to thereby prepare the base paper.

Preparation of a support:

A mixed composition of polyester (limiting viscosity: 6.5, average molecular weight: about 40,000) synthesized by a polycondensation of the dicarboxylic acid composition shown in Table 6 and ethylene glycol or polyethylene, and titanium oxide (KA-10 manufactured by Titan Kogyo Co., Ltd.) were melted and mixed with a double-shaft mixing extruder at 300° C., followed by melting and extruding the mixture from a T die on the surface of the base paper with a thickness of 180 μm to thereby form a laminate layer with a thickness of 30 μm. A calcium carbonate-containing polyethylene terephthalate composition was melted and extruded on the other side at 300° C. to thereby form a laminate layer with a thickness of 30 μm. The resin surface on the side of the reflective support having the laminate layers formed, on which an emulsion was coated, was subjected to a corona discharge treatment and then a subbing solution having the following composition was coated thereon to 5 ml/m$^2$, followed by drying at 80° C. for 2 minutes, whereby Photographic Supports 1 to 4 were obtained.

| Composition of subbing solution: | |
|---|---|
| Compound ExU1 | 0.2 g |
| Compound ExU2 | 0.001 g |
| $H_2O$ | 35 ml |
| Methanol | 65 ml |
| Gelatin | 2 g |
| pH | 9.5 |

TABLE 6

| Support | Resin (Composition of dicarboxylic acid of polyester and the molar ratio thereof) | TiO2 (wt %) |
|---|---|---|
| 1 | Polyester (Terephthalic acid 100) | 20 |
| 2 | Polyester (Terephthalic acid/isophthalic acid 50/50) | 20 |
| 3 | Polyester (Terephthalic acid/naphthalene-dicarboxylic acid 50/50) | 20 |
| 4 | Polyethylene | 20 |

ExU1

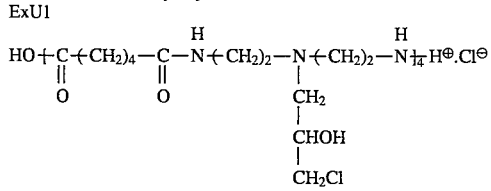

ExU2

$C_{12}H_{25}O(CH_2CH_2O)_{10}H$

The smoothness of these supports was obtained by calculating the center line average roughness (Ra) with the cutoff set at 0.25 mm. The glossiness was obtained by measuring the reflected light at an angle of 60° with a gloss meter manufactured by Suga Test Equipment Co., Ltd. according to JIS B0601. The results are summarized in Table-A.

Preparation of the light-sensitive material

Various photographic structural layers were coated on the support thus obtained to prepare a multi-layer color photographic paper (Sample 101). The coating solutions were prepared in the following manner.

Preparation of the fifth layer coating solution

Ethyl acetate 27.2 ml, a solvent (Solv-3) 5.6 g and a solvent (Solv-7) 1.6 g were added to a cyan coupler (ExC) 12.8 g, a dye image stabilizer (Cpd-9) 1.2 g, a dye image stabilizer (Cpd-8) 0.8 g, a UV absorber (UV-2) 7.2 g, a dye image stabilizer (Cpd-1) 12.0 g, a dye image stabilizer (Cpd-10) 2.0 g, and a dye image stabilizer (Cpd-11) 2.0 g to dissolve them. This solution was added to a 10% gelatin aqueous solution 270 ml containing sodium dodecylbenzenesulfonate 8 ml and then was emulsified and dispersed with a supersonic homogenizer. Silver chlorobromide emulsions R1 and R2 were mixed with the dispersion thus obtained and dissolved, whereby the fifth layer coating solution was prepared.

The coating solutions for the layers other than the fifth layer were prepared in the same manner as the fifth layer coating solution. Sodium 1-oxy-3,5-dichloro-s-triazine and 1,2-bis(vinylsulfonyl)ethane were used as the gelatin hardener for the respective layers.

Further, Cpd-110 and Cpd-111 were added to the respective layers so that the whole amounts thereof became 25.0 mg/m$^2$ and 50.0 mg/m$^2$, respectively.

The following spectral sensitizing dyes were used for the silver chlorobromide emulsions contained in the respective light-sensitive emulsion layers:

Blue-sensitive emulsion layer

Sensitizing dye A

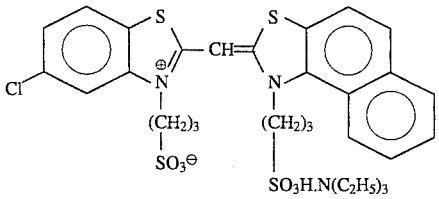

and

-continued

Sensitizing dye B

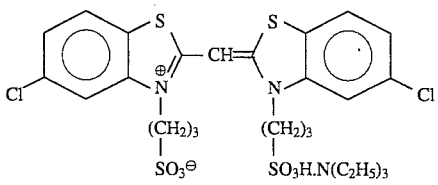

(each $2.0\times10^{-4}$ mole per mole of silver halide to the large size emulsion and each $2.5\times10^{-4}$ mole per mole of silver halide to the small size emulsion).

Green-sensitive emulsion layer

Sensitizing dye C

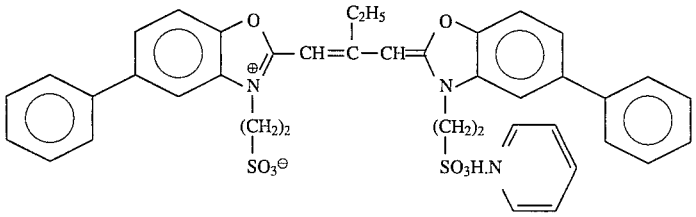

($4.0\times10^{-4}$ mole per mole of silver halide to the large size emulsion and $5.6\times10^{-4}$ mole per mole of silver halide to the small size emulsion)

Sensitizing dye D

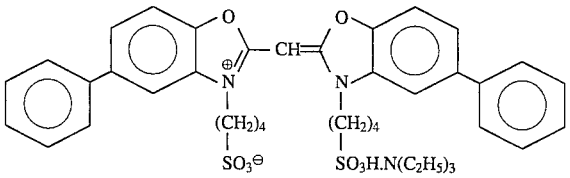

($7.0\times10^{-5}$ mole per mole of silver halide to the large size emulsion and $1.0\times10^{-4}$ mole per mole of silver halide to the small size emulsion).

Red-sensitive emulsion layer

Sensitizing dye E

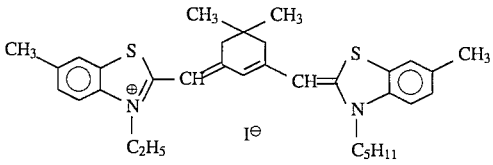

($0.9\times10^{-4}$ mole per mole of silver halide to the large size emulsion and $1.1\times10^{-4}$ mole per mole of silver halide to the small size emulsion).

Further, the following compound was added to the red-sensitive emulsion layer in the amount of $2.6\times10^{-3}$ mole per mole of silver halide:

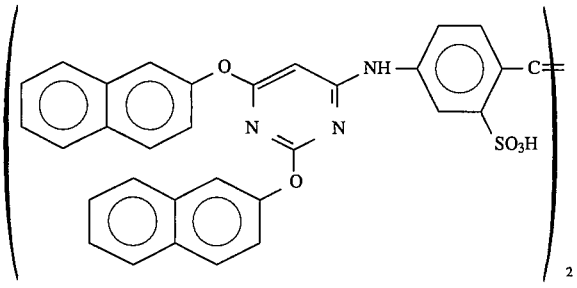

Further, 1-(5-methylureidophenyl)-5-mercaptotetrazole was added to the blue-sensitive layer, green-sensitive layer and red-sensitive layer in the amounts of $3.4\times 10^{-4}$ mole, $9.7\times10^{-4}$ mole and $5.5\times10^{-4}$ mole per mole of silver halide, respectively.

Further, 4-hydroxy-6-methyl-1,3,3a,7-tetrazaindene was added to the blue-sensitive layer and green-sensitive layer in the amounts of $1\times10^{-4}$ mole and $2\times10^{-4}$ mole per mole of silver halide, respectively.

The following dyes (the numerals in parenthesis represent the coated amount) were added to the emulsion layers to prevent irradiation:

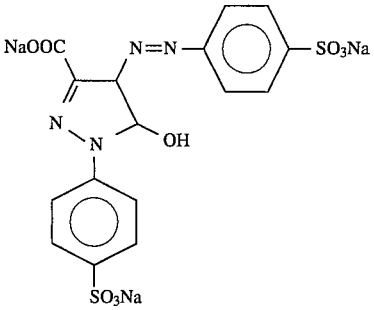

(10mg/m²)

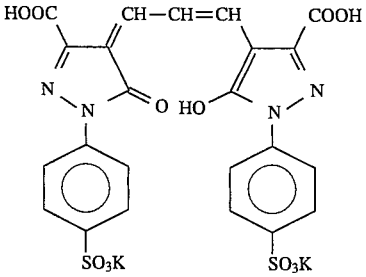

(10mg/m²)

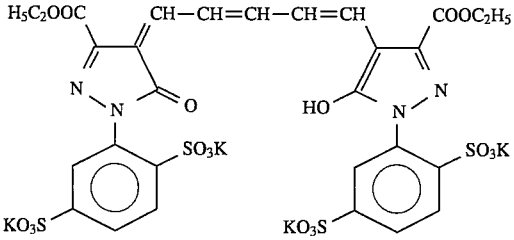

(40mg/m²)

and

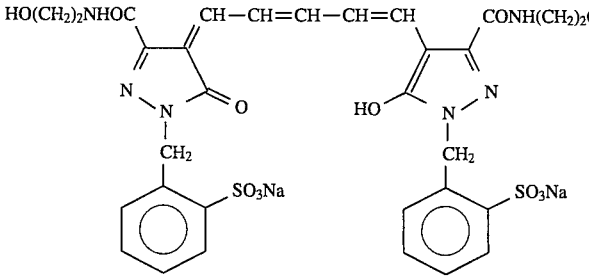

(20mg/m²)

Layer constitution

The compositions of the respective layers are shown below. The numerals represent the coated amounts ($g/m^2$). The coated amounts of the silver halide emulsions are expressed in terms of the amounts converted to silver. The film pH was adjusted to 7.0 by controlling pH of the coating solutions.

Support:

Above mentioned Support 4

| | |
|---|---|
| First layer (a yellow coupler-containing blue-sensitive emulsion layer): | |
| Silver chlorobromide emulsion (cube, 5:5 mixture (Ag mole ratio) of a large size emulsion B1 having an average grain size of 0.8 μm and a small size emulsion B2 having an average grain size of 0.5 μm, wherein the variation coefficients in the grain size distributions were 0.08 and 0.08, respectively, and both size emulsions contained grains in which silver bromide 0.4 mol % was localized on a part of the grain surface and the rest was silver chloride) | 0.27 |
| Gelatin | 1.16 |
| Yellow coupler (ExY) | 0.79 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.10 |
| Solvent (Solv-2) | 0.16 |
| Second layer (an anti-color mixing layer): | |
| Gelatin | 0.99 |
| Anti-color mixing agent (Cpd-4) | 0.08 |
| Dye image stabilizer (Cpd-5) | 0.02 |
| Solvent (Solv-2) | 0.20 |
| Solvent (Solv-3) | 0.30 |
| Third layer (a magenta coupler-containing green-sensitive emulsion layer): | |
| Silver chlorobromide emulsion (cube, 6:4 mixture (Ag mole ratio) of a large size emulsion G1 having an average grain size of 0.55 μm and a small size emulsion G2 having an average grain size of 0.39 μm, wherein the variation coefficients in the grain size distributions were 0.10 and 0.08, respectively; the large size emulsion and the small size emulsion contained grains in which AgBr 0.8 mole % and AgBr 1.0 mole % were localized on a part of the grain surface of the large size emulsion and the small size emulsion, respectively, and the rest was silver chloride) | 0.13 |
| Gelatin | 1.60 |
| Magenta coupler (ExM) | 0.16 |
| Dye image stabilizer (Cpd-6) | 0.15 |

-continued

| | |
|---|---|
| Dye image stabilizer (Cpd-2) | 0.03 |
| Dye image stabilizer (Cpd-7) | 0.01 |
| Dye image stabilizer (Cpd-8) | 0.01 |
| Dye image stabilizer (Cpd-9) | 0.08 |
| Solvent (Solv-3) | 0.50 |
| Solvent (Solv-4) | 0.20 |
| Solvent (Solv-5) | 0.10 |
| Fourth layer (an anti-color mixing layer): | |
| Gelatin | 0.70 |
| Anti-color mixing agent (Cpd-4) | 0.04 |
| Dye image stabilizer (Cpd-5) | 0.01 |
| Solvent (Solv-2) | 0.18 |
| Solvent (Solv-3) | 0.18 |
| Fifth layer (a cyan coupler-containing red-sensitive emulsion layer): | |
| Silver chlorobromide emulsion (cube, 7:3 mixture (Ag mole ratio) of a large size emulsion R1 having an average grain size of 0.58 μm and a small size emulsion R2 having an average grain size of 0.45 μm, wherein the variation coefficients in the grain size distributions were 0.09 and 0.11, respectively, the large size emulsion and the small size emulsion contained grains in which AgBr 0.6 mole % and AgBr 0.8 mole % were localized on a part of the grain surface of the large size emulsion and the small size emulsion, respectively, and the rest was silver chloride) | 0.20 |
| Gelatin | 1.04 |
| Cyan coupler (ExC) | 0.32 |
| Dye image stabilizer (Cpd-1) | 0.30 |
| UV absorber (UV-2) | 0.18 |
| Dye image stabilizer (Cpd-10) | 0.05 |
| Dye image stabilizer (Cpd-11) | 0.05 |
| Dye image stabilizer (Cpd-9) | 0.03 |
| Dye image stabilizer (Cpd-8) | 0.02 |
| Solvent (Solv-3) | 0.14 |
| Solvent (Solv-7) | 0.04 |
| Sixth layer (a UV absorbing layer): | |
| Gelatin | 0.55 |
| UV absorber (UV-1) | 0.40 |
| Dye image stabilizer (Cpd-13) | 0.15 |
| Dye image stabilizer (Cpd-6) | 0.02 |
| Seventh layer (a protective layer): | |
| Gelatin | 1.13 |
| Acryl-modified copolymer of polyvinyl alcohol (modification degree: 17%) | 0.15 |
| Liquid paraffin | 0.03 |
| Dye image stabilizer (Cpd-14) | 0.01 |

The compounds used here are shown below:

(ExY) Yellow coupler

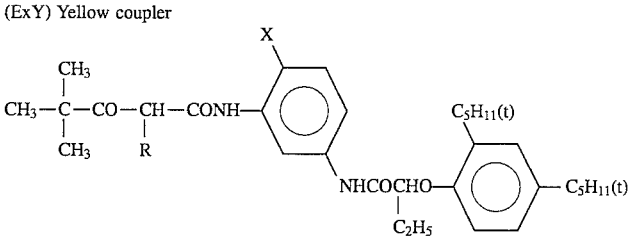

1:1 mixture (mole ratio) of

-continued
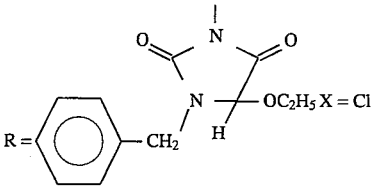
and
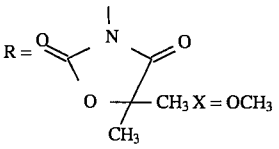
(ExM) Magenta coupler
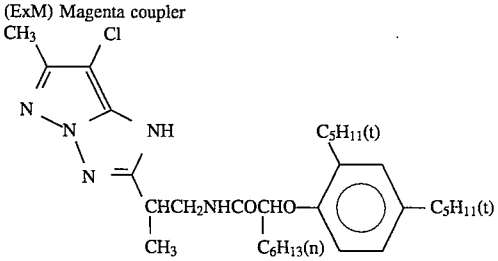
(ExC) Cyan coupler
3:7 mixture (mole ratio) of
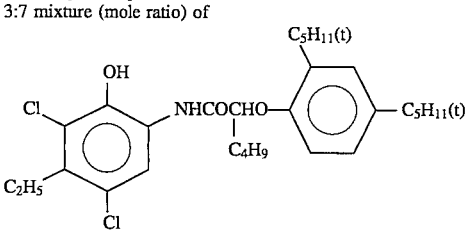
and
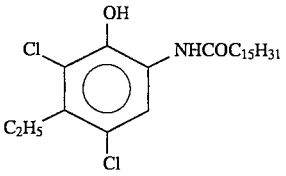
(Cpd-1) Dye image stabilizer
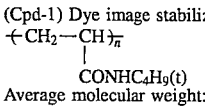
Average molecular weight: 60,000
(Cpd-2) Dye image stabilizer
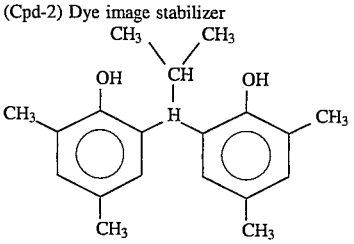
(Cpd-3) Dye image stabilizer -continued
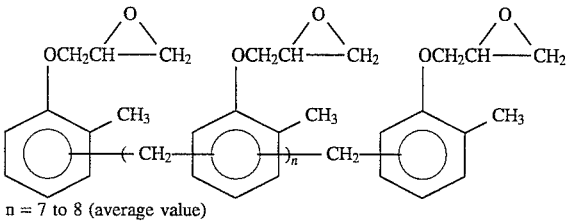
n = 7 to 8 (average value)
(Cpd-4) Anti-color mixing agent
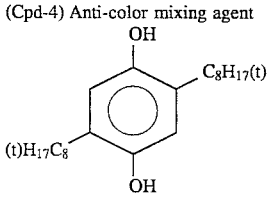
(Cpd-5) Dye image stabilizer
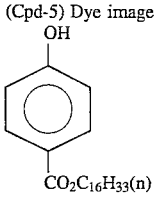
(Cpd-6) Dye image stabilizer
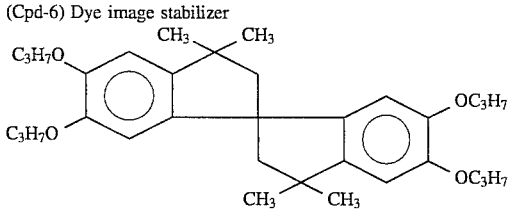
(Cpd-7) Dye image stabilizer
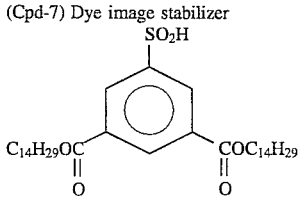
(Cpd-8) Dye image stabilizer
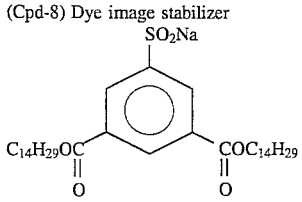
(Cpd-9) Dye image stabilizer
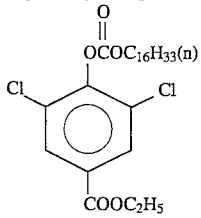
(Cpd-10) Dye image stabilizer -continued
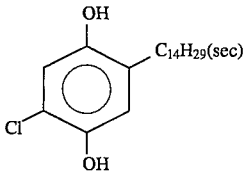
(Cpd-11) Dye image stabilizer
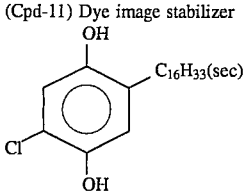
(Cpd-13) Dye image stabilizer
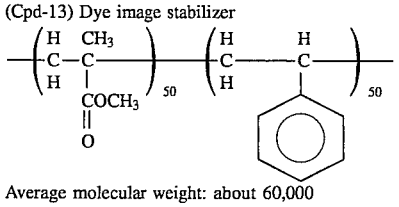
Average molecular weight: about 60,000
(Cpd-14) Dye image stabilizer
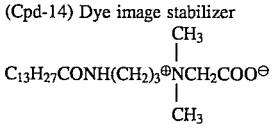
(Cpd-110) Preservative
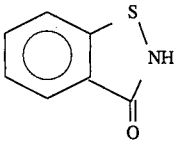
(Cpd-111) Preservative
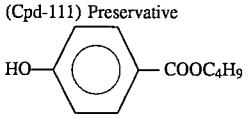
UV absorber (UV-1)
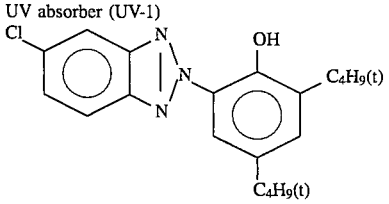
(1)
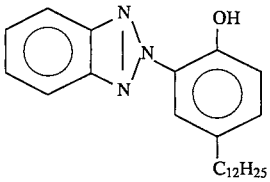
(2)
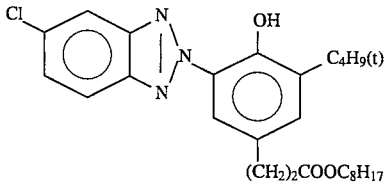
(3)

-continued

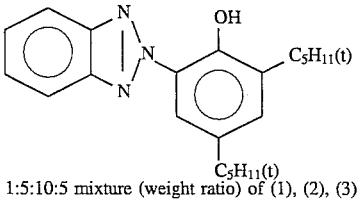

(4)

1:5:10:5 mixture (weight ratio) of (1), (2), (3) and (4)

(UV-2) UV absorber

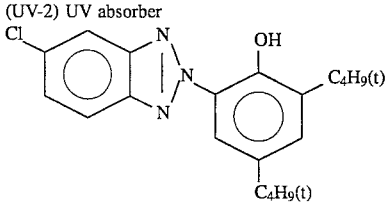

(1)

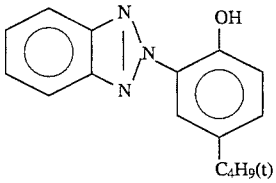

(2)

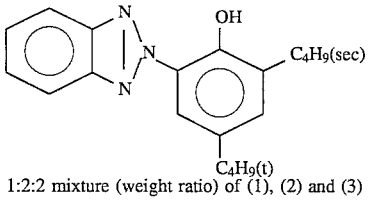

(3)

1:2:2 mixture (weight ratio) of (1), (2) and (3)

Solvent (Solv-1)

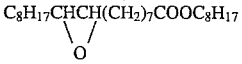

Solvent (Solv-2)

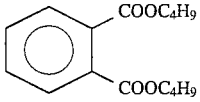

Solvent (Solv-3)

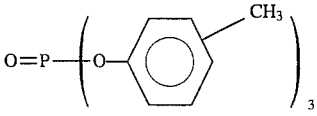

Solvent (Solv-4)

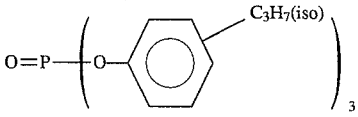

Solvent (Solv-5)

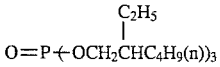

Solvent (Solv-7)

Samples 102 to 124 were prepared in the same manner as Sample 101 thus obtained, except that the support, the cyan coupler, and the film pH were changed as shown in Table-A.

In order to check the sub-absorptions in a short wavelength region of the cyan color dyes in the twenty four (24) light-sensitive materials obtained above, a 1/10 second exposure was given through a red color filter and then a color development processing was carried out in the processing solutions shown below. Subsequently, an absorption spectrum was obtained with a commercially available spectrophotometer (UV-365 manufactured by Shimazu Mfg. Co., Ltd.) with a white plate as the reference therefor to thereby obtain the ratio of the absorbency at 400 nm to that at 650 nm.

Next, for the purpose of checking the change caused when a pressure was exerted on the light-sensitive material, the light-sensitive material immediately after coating and the light-sensitive material after aging at 35° C. and 55% RH for one week were scratched with a sapphire needle (radius of curvature at the needle end: 0.03 mm) loaded with 2 g, 4 g and 8 g at a speed of 5 cm/second. Then, they were developed according to the following processes to check if a pressure fog was generated. The results were classified as follows:

D: fog was observed at the load of 2 g;
C: fog was observed at the load of 4 g;
B: fog was observed at the load of 8 g; and
A: fog was not observed even at the load of 8 g.

The above results are summarized in Table-A.

The compositions of the respective processing solutions are as follows:

| | Tank solution | Replenishing solution |
|---|---|---|
| Color developing solution | | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25. g | 25 g |
| N-ethyl-N-(β-methanesulfonamidethyl)-3-methyl-4-aminoaniline sulfate | 5.0 g | 7.0 g |
| N,N-bis(carboxymethyl)hydrazine | 4.0 g | 5.0 g |
| Monosodium N,N-di(sulfoethyl) hydroxylamine | 4.0 g | 5.0 g |
| Fluorescent whitening agent (Whitex 4B manufactured by Sumitomo Chem. Ind. Co., Ltd.)) | 1.0 g | 2.0 g |
| Water was added to | 1000 ml | 1000 ml |
| pH (25° C.) | 10.05 | 10.45 |

TABLE-A

| Sample No. | Support | Cyan coupler | Film pH | Smoothness[1)] | Glossiness[2)] | Sub-absorption in cyan dye[3)] | Pressure fog before aging[4)] | Pressure fog after aging[4)] |
|---|---|---|---|---|---|---|---|---|
| 101 (Comp.) | 4 | ExC | 7.0 | 0.12 | 85 | 0.21 | A | A |
| 102 (Comp.) | 4 | ExC | 6.5 | 0.12 | 85 | 0.21 | A | A |
| 103 (Comp.) | 4 | ExC | 5.9 | 0.12 | 85 | 0.21 | A | A |
| 104 (Comp.) | 4 | (11) | 7.0 | 0.12 | 85 | 0.04 | A | B |
| 105 (Comp.) | 4 | (11) | 6.5 | 0.12 | 85 | 0.04 | A | A |
| 106 (Comp.) | 4 | (11) | 5.9 | 0.12 | 85 | 0.04 | A | A |
| 107 (Comp.) | 1 | ExC | 7.0 | 0.02 | 110 | 0.21 | A | B |
| 108 (Comp.) | 1 | ExC | 6.5 | 0.02 | 110 | 0.21 | A | A |
| 109 (Comp.) | 1 | ExC | 5.9 | 0.02 | 110 | 0.21 | A | A |
| 110 (Comp.) | 1 | (11) | 7.0 | 0.02 | 110 | 0.04 | B | D |
| 111 (Inv.) | 1 | (11) | 6.5 | 0.02 | 110 | 0.04 | A | B |
| 112 (Inv.) | 1 | (11) | 5.9 | 0.02 | 110 | 0.04 | A | A |
| 113 (Comp.) | 2 | ExC | 7.0 | 0.02 | 105 | 0.21 | A | B |
| 114 (Comp.) | 2 | ExC | 6.5 | 0.02 | 105 | 0.21 | A | A |
| 115 (Comp.) | 2 | ExC | 5.9 | 0.02 | 105 | 0.21 | A | A |
| 116 (Comp.) | 2 | (11) | 7.0 | 0.02 | 105 | 0.04 | B | D |
| 117 (Inv.) | 2 | (11) | 6.5 | 0.02 | 105 | 0.04 | A | B |
| 118 (Inv.) | 2 | (11) | 5.9 | 0.02 | 105 | 0.04 | A | A |
| 119 (Comp.) | 3 | ExC | 7.0 | 0.02 | 101 | 0.21 | A | B |
| 120 (Comp.) | 3 | ExC | 6.5 | 0.02 | 101 | 0.21 | A | A |
| 121 (Comp.) | 3 | ExC | 5.9 | 0.02 | 101 | 0.21 | A | A |
| 122 (Comp.) | 3 | (11) | 7.0 | 0.02 | 101 | 0.04 | B | D |
| 123 (Inv.) | 3 | (11) | 6.5 | 0.02 | 101 | 0.04 | A | B |
| 124 (Inv.) | 3 | (11) | 5.9 | 0.02 | 101 | 0.04 | A | A |

[1)]Smoothness: the smaller the value is, the better the smoothness is.
[2)]Glossiness: the larger the value is, the better the glossiness is.
[3)]Sub-absorption in the cyan color dye: the smaller the value is, the better the sub-absorption is.
[4)]The order of good to bad is A, B, C and D.

| Processing step | Temperature | Time | Replenishing amount* | Tank capacity |
|---|---|---|---|---|
| Color developing | 35° C. | 45 seconds | 161 ml | 17 l |
| Bleach/fixing | 30 to 35° C. | 45 seconds | 215 ml | 17 l |
| Rinsing | 30° C. | 90 seconds | 350 ml | 10 l |
| Drying | 70 to 80° C. | 60 seconds | | |

*Replenishing amount: per $m^2$ of the light-sensitive material.

-continued

| | Tank solution | Replenishing solution |
|---|---|---|
| Bleach/fixing solution | | |
| (The tank solution and replenishing solution were the same) | | |
| Water | | 400 ml |
| Ammonium thiosulfate (700 g/liter) | | 100 ml |
| Sodium sulfite | | 17 g |

| | Tank solution | Replenishing solution |
|---|---|---|
| Iron (III) ammonium ethylenediamine-tetracetate | | 55 g |
| Disodium ethylenediaminetetraacetate | | 5 g |
| Ammonium bromide | | 40 g |
| Water was added to | | 1000 ml |
| pH (25° C.) | | 6.0 |
| Rinsing solution | | |
| (The tank solution and replenishing solution were the same) Deionized water (contents of calcium and magnesium: each 3 ppm or less) | | |

The effects of the present invention are apparent from the results shown in Table-A. That is, the light-sensitive materials having a film pH exceeding 6.5 while having a high smoothness and glossiness and less sub-absorption in the cyan color dye have a deteriorated pressure fog after storing for aging (Samples 110, 116, and 122). A decrease in the film pH to 6.5 or less can improve the pressure fog (Samples 111, 112, 117, 118, 123, and 124).

EXAMPLE 2

Samples 201 to 222 were prepared in the same manner as Sample 101 of Example 1, except that the compositions of the second layer to the fourth layer in Sample 101 were changed as shown below and the support, the cyan coupler, and the film pH were varied as shown in Table-B. Samples 201 to 222 were evaluated in the same manner as in Example 1 and it was found that similar results were obtained.

| | |
|---|---|
| Second layer (an anti-color mixing layer): | |
| Gelatin | 0.99 |
| Anti-color mixing agent (Cpd-A) | 0.04 |
| Anti-color mixing agent (Cpd-B) | 0.04 |
| Solvent (Solv-10) | 0.16 |
| Solvent (Solv-11) | 0.08 |
| Solvent (Solv-12) | 0.03 |
| Third layer (a magenta coupler-containing green-senstive emulsion layer) | |
| Silver chlorobromide emulsions G1, G2 used in Example 1 | 0.12 |
| Gelatin | 1.24 |
| Magenta coupler (M-A) | 0.26 |
| Dye image stabilizer (Cpd-16) | 0.03 |
| Dye image stabilizer (Cpd-17) | 0.04 |
| Dye image stabilizer (Cpd-18) | 0.02 |
| Dye image stabilizer (Cpd-19) | 0.02 |
| Solvent (Solv-8) | 0.30 |
| Solvent (Solv-9) | 0.15 |
| Gelatin | 1.24 |
| Fourth layer (an anti-color mixing layer): | |
| Gelatin | 0.70 |
| Anti-color mixing agent (Cpd-A) | 0.03 |
| Anti-color mixing agent (Cpd-B) | 0.03 |
| Solvent (Solv-10) | 0.11 |
| Solvent (Solv-11) | 0.06 |
| Solvent (Solv-12) | 0.02 |

(Cpd-16) Dye image stabilizer

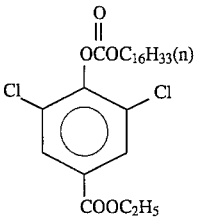

(Cpd-17) Dye image stabilizer

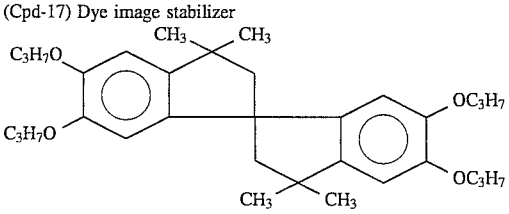

(Cpd-18) Dye image stabilizer
1:1 mixture (mole ratio) of

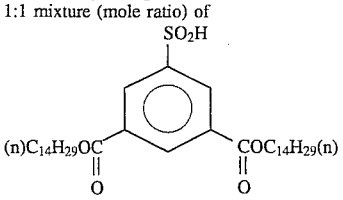

and

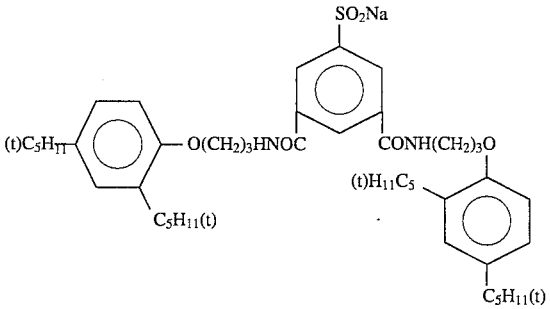

(Cpd-19) Dye image stabilizer

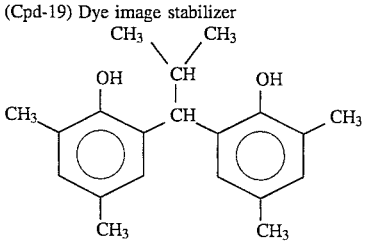

Cpd-A

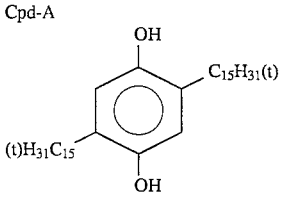

Cpd-B

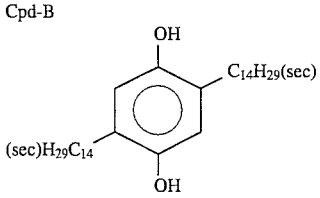

M-A

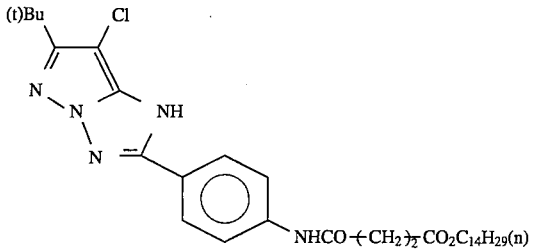

(Solv-8) Solvent $O{=}P{\leftarrow}O{-}C_6H_{13}(n))$ (Solv-9) Solvent

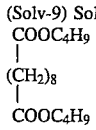

(Solv-10) Solvent

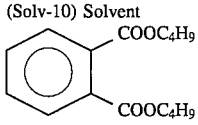

(Solv-11) Solvent

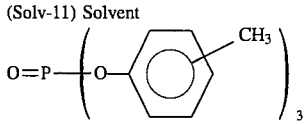

(Solv-12) Solvent

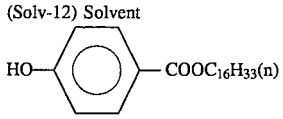

EXAMPLE 3

Second sets of Samples 101 to 124 and 201 to 222 prepared in the same manner as Samples 101 to 124 and 201 to 222 in Example 1 and Example 2, respectively, were processed and evaluated in the same manner as in Example 1, except that the samples were exposed in the following manner. The results obtained were the same as those in Examples 1 and 2.

Exposure:

There was used as a light source, a 473 nm wavelength light obtained by subjecting a YAG solid state laser (oscillation wavelength: 946 nm) in which a semiconductor laser GaAlAs (oscillation wavelength: 808.5 nm) was used as an exciting light source to a wavelength modulation with a SHG crystal of $KNbO_3$, a 532 nm wavelength light obtained by subjecting a $YVO_4$ solid state laser (oscillation wavelength: 1064 mm) in which a semiconductor laser GaAlAs (oscillation wavelength: 808.7 nm) was used as an exciting light source to a wavelength modulation with a SHG crystal of KTP, and 670 nm wavelength light from AlGaInP (oscillation wavelength: about 670 nm: Type No. TOLD 9211 manufactured by Toshiba Co., Ltd.). A laser scanner was used in which a laser ray could be scanned for exposing in order on a color photographic paper moving in a direction perpendicular to the scanning direction with a rotary polyhedron. The relationship of the density (D) of the light-sensitive material with the quantity of light, D-log E, was obtained with this equipment while changing the quantity of light, wherein the laser rays of the three wavelengths were subjected to modulation of the quantity of light by means of an external modulator to thereby control the exposure. This scanning exposure was carried out at 400 dpi, wherein the average exposing time per picture element was about $5\times10^{-8}$ second. A Peltier element was used to maintain the temperature constant in order to control the change in the quantity of light caused by the change in the temperature.

TABLE-B

| Sample No. | Support | Cyan coupler | Film pH | Smoothness | Glossiness | Sub-absorption in cyan dye | Pressure fog before aging | Pressure fog after aging |
|---|---|---|---|---|---|---|---|---|
| 201 (Comp.) | 4 | ExC | 7.0 | 0.12 | 85 | 0.21 | A | A |
| 202 (Comp.) | 4 | ExC | 5.9 | 0.12 | 85 | 0.21 | A | A |
| 203 (Comp.) | 4 | (11) | 7.0 | 0.12 | 85 | 0.04 | A | B |
| 204 (Comp.) | 4 | (11) | 5.9 | 0.12 | 85 | 0.04 | A | A |
| 205 (Comp.) | 1 | ExC | 7.0 | 0.02 | 110 | 0.21 | A | B |
| 206 (Comp.) | 1 | ExC | 6.7 | 0.02 | 110 | 0.21 | A | B |
| 207 (Comp.) | 1 | ExC | 6.5 | 0.02 | 110 | 0.21 | A | A |
| 208 (Comp.) | 1 | ExC | 6.2 | 0.02 | 110 | 0.21 | A | A |
| 209 (Comp.) | 1 | ExC | 5.9 | 0.02 | 110 | 0.21 | A | A |
| 110 (Comp.) | 1 | ExC | 5.5 | 0.02 | 110 | 0.21 | A | A |
| 211 (Comp.) | 1 | (11) | 7.0 | 0.02 | 110 | 0.04 | B | D |
| 212 (Comp.) | 1 | (11) | 6.7 | 0.02 | 110 | 0.04 | B | C |
| 213 (Inv.) | 1 | (11) | 6.5 | 0.02 | 110 | 0.04 | A | B |
| 214 (Inv.) | 1 | (11) | 6.2 | 0.02 | 110 | 0.04 | A | B |
| 215 (Inv.) | 1 | (11) | 5.9 | 0.02 | 110 | 0.04 | A | A |
| 216 (Inv.) | 1 | (11) | 5.5 | 0.02 | 110 | 0.04 | A | A |
| 217 (Comp.) | 1 | (35) | 7.0 | 0.02 | 110 | 0.05 | B | D |
| 218 (Inv.) | 1 | (35) | 6.5 | 0.02 | 110 | 0.05 | A | B |
| 219 (Inv.) | 1 | (35) | 5.9 | 0.02 | 110 | 0.05 | A | A |
| 220* (Comp.) | 1 | (21) | 7.0 | 0.02 | 110 | 0.04 | B | D |
| 221 (Inv.) | 1 | (21) | 6.5 | 0.02 | 110 | 0.04 | A | B |
| 222 (Inv.) | 1 | (21) | 5.9 | 0.02 | 110 | 0.04 | A | A |

*In Samples 220 to 222, the coated amount of the silver halide emulsion contained in the cyan coupler-containing layer was reduced to 60% of that in the other samples.

While the invention has been described in detail and with reference to specific embodiments thereof, it will be aparent to one skilled in the art that various changes and modifications can be made therein without departing from the spirit and scope thereof.

What is claimed is:

1. A silver halide color photographic light-sensitive material comprising a reflective support having provided thereon at least one yellow dye forming coupler-containing silver halide emulsion layer, at least one magenta dye forming coupler-containing silver halide emulsion layer, and at least one cyan dye forming coupler-containing silver halide emulsion layer each having a different light sensitivity, wherein the reflective support comprises a substrate having provided at least on the surface of an emulsion layer-coated side thereof, a composition prepared by mixing and dispersing a white pigment in a resin containing polyester as a main component; the cyan dye forming coupler-containing silver halide emulsion layer contains at least one cyan dye forming coupler compound represented by the following formula (Ia); a binder or protective colloid used in the light-sensitive material is low calcium gelatin having a calcium content of 200 ppm or less; and the film pH of the light-sensitive material is 4.0 to 6.5:

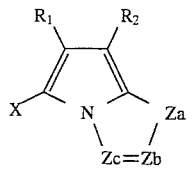

(Ia)

wherein Za represents —NH— or —CH($R_3$)—, and Zb and Zc each represents —C($R_4$)= or —N=; $R_1$, $R_2$ and $R_3$ each represents an electron attractive group having a Hammett's substituent constant $\sigma_p$ of 0.20 or more, provided that the sum of the $\sigma_p$ values of $R_1$ and $R_2$ is 0.65 or more; $R_4$ represents a hydrogen atom or a substituent, provided that when two $R_4$'s are present in the formula, they may be the same or different; X represents a hydrogen atom or a group capable of splitting off upon a reaction with an oxidation product of an aromatic primary amine color developing agent; and a group represented by $R_1$, $R_2$, $R_3$, $R_4$ or X may become a divalent group and combine with a polymer higher than a dimer and a high molecular chain to form a homopolymer or a copolymer.

2. The silver halide color photographic light-sensitive material as in claim 1, wherein the polyester coated on the reflective support is a polyester containing polyethylene terephthalate as a main component.

3. The silver halide color photographic light-sensitive material as in claim 2, wherein the diol component is ethylene glycol.

4. The silver halide color photographic light-sensitive material as in claim 3, wherein the white pigment is titanium oxide; and the weight ratio of titanium oxide to the resin containing polyester as the main component is 5/95 to 50/50.

5. The silver halide color photographic light-sensitive material as in claim 2, wherein the white pigment is titanium oxide; and the weight ratio of titanium oxide to the resin containing polyester as the main component is 5/95 to 50/50.

6. The silver halide color photographic light-sensitive material as in claim 1, wherein the polyester coated on the reflective support is polyester obtained by the polycondensation of a dicarboxylic acid and a diol; and the dicarboxylic acid component is a mixture of terephthalic acid and isophthalic acid.

7. The silver halide color photographic light-sensitive material as in claim 6, wherein the diol component is ethylene glycol.

8. The silver halide color photographic light-sensitive material as in claim 6, wherein the white pigment is titanium oxide; and the weight ratio of titanium oxide to the resin containing polyester as the main component is 5/95 to 50/50.

9. The silver halide color photographic light-sensitive material as in claim 1, wherein the polyester coated on the reflective support is a polyester obtained by the polycondensation of a dicarboxylic acid and a diol; and the dicarboxylic acid component is a mixture of terephthalic acid and naphthalenedicarboxylic acid.

10. The silver halide color photographic light-sensitive material as in claim 9, wherein the diol component is ethylene glycol.

11. The silver halide color photographic light-sensitive material as in claim 9, wherein the white pigment is titanium oxide; and the weight ratio of titanium oxide to the resin containing polyester as the main component is 5/95 to 50/50.

12. The silver halide color photographic light-sensitive material as in claim 1, wherein the white pigment is titanium oxide; and the weight ratio of titanium oxide to the resin containing polyester as the main component is 5/95 to 50/50.

13. The silver halide color photographic light-sensitive material as in claim 1, wherein the support has a center line average surface roughness (SRa) defined by the value obtained from the following equation of 0.15 μm or less:

$$SRa = \frac{1}{SM} \int_0^{Lx} \int_0^{Ly} |f(X, Y)| dX \cdot dY$$

$$Lx\ Ly = SM$$
$$Z = f(X, Y)$$

14. The silver halide color photographic light-sensitive material as in claim 13, wherein the SRa is 0.10 μm or less.

15. The silver halide color photographic light-sensitive material as in claim 1, wherein the cyan dye forming coupler compound is represented by formula (IIa), (IIIa), (IVa), (Va), (VIa), (VIIa) or (VIIIa)

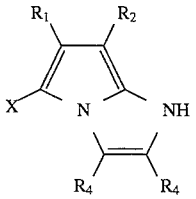

(IIa)

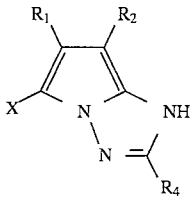

(IIIa)

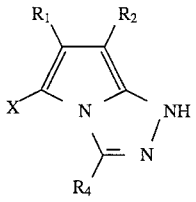

(IVa)

-continued (Va)

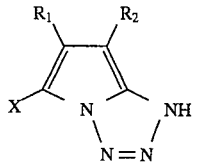

(VIa)

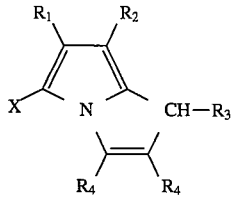

(VIIa)

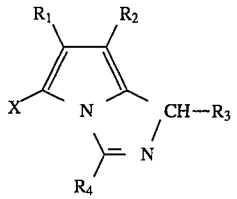

(VIIIa)

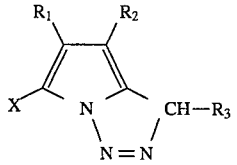

wherein $R_1$, $R_2$, $R_3$, $R_4$ and X have the same meaning as in claim 1.

16. The silver halide color photographic light-sensitive material as in claim 15, wherein the cyan dye forming coupler compound is represented by formula (IIa), (IIIa) or (IVa).

17. The silver halide color photographic light-sensitive material as in claim 15, wherein the cyan dye forming coupler compound is represented by formula (IIIa).

18. The silver halide color photographic light-sensitive material as in claim 1, wherein the material has a film pH of 5.0 to 6.0.

19. The silver halide color photographic light-sensitive material as in claim 1, wherein at least one of the emulsion layers comprises silver chloride, silver chlorobromide or silver chloroiodobromide grains each having a silver chloride content of 95 mol % or more and a silver iodide content of 1 mol % or less.

20. The silver halide color photographic light-sensitive material as in claim 19, wherein the silver chloride, silver chlorobromide or silver chloroiodobromide grains contain metal ions or metal complexes belonging to Group VIII, Group IIb, lead ion, or thallium ion.

* * * * *